US005600346A

United States Patent [19]

Kamata et al.

[11] Patent Number: 5,600,346

[45] Date of Patent: Feb. 4, 1997

[54] MULTIWINDOW DISPLAY CONTROL METHOD AND APPARATUS

[75] Inventors: Hajime Kamata; Tsuneo Katsuyama; Toshimitsu Suzuki, all of Kawasaki; Yu Minakuchi; Katsutoshi Yano, both of Tokyo, all of Japan

[73] Assignee: Fujitsu Limited, Kawasaki, Japan

[21] Appl. No.: 717,904

[22] Filed: Jun. 19, 1991

[30] Foreign Application Priority Data

Jun. 19, 1990 [JP] Japan ..... 2-161087
Sep. 14, 1990 [JP] Japan ..... 2-245372

[51] Int. Cl.[6] ..... G09G 5/14

[52] U.S. Cl. ..... 345/120; 395/314

[58] Field of Search ..... 345/119, 120, 345/115, 116, 118, 201; 395/153, 154, 157, 158, 159, 160

[56] References Cited

U.S. PATENT DOCUMENTS

| | | | |
|---|---|---|---|
| 4,688,167 | 8/1987 | Agarwal | 345/113 |
| 4,712,191 | 12/1987 | Penna | 395/159 |
| 4,723,209 | 2/1988 | Hernandez et al. | 345/116 |
| 4,940,971 | 7/1990 | Hasebe | 345/120 |
| 5,129,055 | 7/1992 | Yamazaki | 345/120 |
| 5,191,644 | 3/1993 | Takeda | 345/120 |
| 5,241,656 | 8/1993 | Loucks et al. | 345/120 |

FOREIGN PATENT DOCUMENTS

| | | |
|---|---|---|
| 0249696 | 12/1987 | European Pat. Off. . |
| 0349455 | 1/1990 | European Pat. Off. . |

OTHER PUBLICATIONS

Gohda, et al., "Viewport Priority Circuit", *IBM Technical Disclosure Bulletin,* pp. 3656–3657, Dec., vol. 27, No. 7A, 1984.

Communication pursuant to Article 96(2) and Rule 51(2) EPC (European Patent Office); Aug. 17, 1994; Ref: 84PAT947–EP; 5 pages.

Brad A. Myers, "Window Interfaces A Taxonomy of Window Manager User Interfaces", I.E.E.E. *Computer Graphics and Applications* 8(1988) Sep. No. 5, pp. 65–84, New York.

*Primary Examiner*—Richard Hjerpe
*Assistant Examiner*—Kara Farnandez Stoll
*Attorney, Agent, or Firm*—Staas & Halsey

[57] ABSTRACT

A multiwindow display control method and apparatus for easily controlling a display of a plurality of groups of windows each group including a plurality of windows. The invention includes plural frame memory control units each storing pixel data to be displayed on one of the windows, a first group number of a group of windows to which the window belongs, and a priority number for identifying a display priority among the windows included in the same group of windows. The invention further provides an outline generating unit for generating a second group number each identifying one of the group of windows; a pixel data arbitration unit for determining a group of windows having the first group number which coincides with the second group number, and for determining a window to be displayed having a highest priority number of the determined group of windows; and a display unit for displaying pixel data of the determined window.

17 Claims, 29 Drawing Sheets

GN=1
W10
W11
W12
GN=2
W20
W21
FRAME MEMORY CONTROL UNIT
12-1
GN=3, PN = 1
W30
13-1
12-2
GN = 1, PN = 1
W10
13-2
12-3
GN = 1, PN=2
W11
13-3
12-6
GN=2, PN=2
W21
13-6
11
xa
xb
GN=3
GN = 1
xc
GN=2
PIXEL DATA ARBITRATION UNIT
14
DISPLAY INTERFACE UNIT
16
W30
W10
W11
W12
W21
W20
DISPLAY SCREEN
20

10
17
SYSTEM BUS
81
BUS INTERFACE CIRCUIT
82
REFRESH ADDRESS / CONTROL SIGNAL GENERATING CIRCUIT
83
SERIAL PORT ADDRESS / CONTROL SIGNAL GENERATING CIRCUIT
84
SELECTOR
86
TIMING ARBITRATION CIRCUIT
11
GROUP NUMBER STORING FRAME MEMORY
85
TIMING GENERATING CIRCUIT
REFRESH TIMING
RANDOM PORT ACCESS TIMING
SERIAL PORT ACCESS TIMING
87
PIXEL DATA MULTIPLEXING CIRCUIT
GN
104
105
106

GROUP WINDOW REGION SIGNAL

SIGNAL (a)

SIGNAL (b)

SIGNAL (c)

CENERATION/ERASE

CHANGE OF OVER LAPPING

MOVE

CHANGE OF SIZE

GENERATION/ERASE

MOVE

CHANGE OF OVER LAPPING

CHANGE OF SIZE

MULTIWINDOW DISPLAY CONTROL METHOD AND APPARATUS

BACKGROUND OF THE INVENTION (1) Field of the Invention

The present invention relates to a multiwindow display control method and apparatus to control a multiwindow display.

A multiwindow display provides an environment in which a plurality of windows are displayed on a single screen, whereby users can efficiently carry out various jobs at the same time. The multiwindow display has become essential in the construction of a human-computer interface, such as a work station.

(2) Description of the Related Art

In a conventional multiwindow display, a technique is required by which the required functions of a high speed display and high degree of freedom in displaying the multiwindow display are obtained.

Therefore, in a conventional multiwindow system, a plurality of frame memories each of the same size as a display screen are provided, or a single frame memory having a size larger than the display screen is provided. In the former case, each frame memory stores pixel data of a single window, and in the latter case, the larger size frame memory stores pixel data of a plurality of windows. In both cases, to combine the pixel data of the windows, conventional hardware is used to directly synthesize or combine the pixel data of each window in the frame memory, to thereby obtain a multiwindow display screen image which is displayed on a display screen.

For example, assuming that pixel data of the respective windows are stored in different locations in the larger size frame memory, and that window display control data such as storing location, display point, overlapping priority and so forth are set in a controller. Then, the hardware displays the windows on the display screen, based on the window display control data, by switching the reading location from the frame memory synchronously with the display timing.

Therefore, in the conventional hardware window system, it is necessary only to set necessary window display control data corresponding to the respective windows in the controller, and thus there is advantageously obtained a high speed display switching capability.

Accordingly, basic operations such as the generating/erasing of a window, movement of a window, change of an overlapping of the windows, or a change of the size of a window, can be carried out by the above mentioned conventional example, but it is difficult to manage the plurality of windows as a single group window in a convenient, efficient manner.

Because of the high degree amount of human interface or interaction in recent years, there is a need to provide a high degree of freedom of operation which simulates the human interaction by which a linking among a plurality of windows, such as a page movement or page turning operation, can be obtained. Note, in this case, each page constitutes a group of windows including a plurality of windows.

To realize such a high degree of freedom of operation such as a page turning operation or a page movement, overlapping display control is necessary, and in such an overlapping display, a plurality of groups of windows are simultaneously displayed on a screen.

Conventionally, the overlapping display control is carried out using a single variable, i.e., a priority of each window with respect to the display order is used regardless of the group of windows to which the windows belong, and therefore, it is very difficult to carry out an overlapping display of the groups of windows. Namely, in the conventional technique for effecting the overlapping display control of the group windows, the load on software is very heavy and thus the advantage of a satisfactory high speed display by hardware cannot be obtained. A group of windows is also hereinafter referred to as a group window.

As described above, in the conventional example, a problem arises in the complexity of the operations for controlling change of a display of a plurality of groups of windows each including a plurality of windows.

SUMMARY OF THE INVENTION

Therefore, an object of the present invention is to solve the above mentioned problem and to provide a means capable of carrying out a simple control of a change of a display of a plurality of groups of windows each group of windows including a plurality of windows.

To attain the above object, according to the present invention, there is provided a multiwindow display control method for controlling a display of multiwindows consisting of a plurality of groups of windows, each group including a plurality of windows, including the following steps. Storing pixel data in each of a plurality of frame memory control units corresponding respectively to the windows, and storing a first group number in each of the frame memory control units, the first group number being used for identifying a group window to which the window belongs. In addition, the invention provides the steps of storing a priority number in each of the frame memory control units, the priority number being used for identifying a display priority in the windows included in the same group of windows; generating a second group number of a window to be displayed from an outline generating unit; and determining a group of windows having a first group number which coincides with or is the same as the second group number. Further, the invention includes the steps of determining a window having a highest priority number among the determined group of windows; and displaying the pixel data of the determined window, the pixel data being read from the frame memory control unit which corresponds to the determined window.

Further, according to the present invention, there is provided a multiwindow display control apparatus for controlling display of multiwindows consisting of a plurality of groups of windows each group including a plurality of windows, including a plurality of frame memory control units each storing pixel data to be displayed on one of the windows, a first group number of a group of windows to which the window belongs, and a priority number for identifying a display priority of the windows included in the same group of windows. In addition, the apparatus includes an outline generating unit for generating second group numbers each identifying one of the group of windows. Further, the apparatus provides a pixel data arbitration unit, operatively connected to the frame memory control units and to the outline generating unit, for determining a group of windows having the first group number which coincides with the second group number, and for determining a window to be displayed having a highest priority number among the determined group of windows. Finally, a display unit is provided, operatively connected to the pixel data arbitration unit, for displaying pixel data of the determined window.

BRIEF DESCRIPTION OF THE DRAWINGS

The above-described features and advantages of the present invention will be more apparent from the following description of the preferred embodiments, made with reference to the accompanying drawings, wherein.

DESCRIPTION OF THE PREFERRED EMBODIMENTS

For a better understanding of the present invention, a conventional hardware window system, a general window basic operation, a group window basic operation for explaining the subject of the present invention, and a page turning operation as an example of an application of an overlapping change operation in the basic operation of the group window will be first described with reference to FIG. 23, FIGS. 24A to 24D, FIGS. 25A to 25D, and FIGS. 26A to 26C, respectively.

Figure 23:
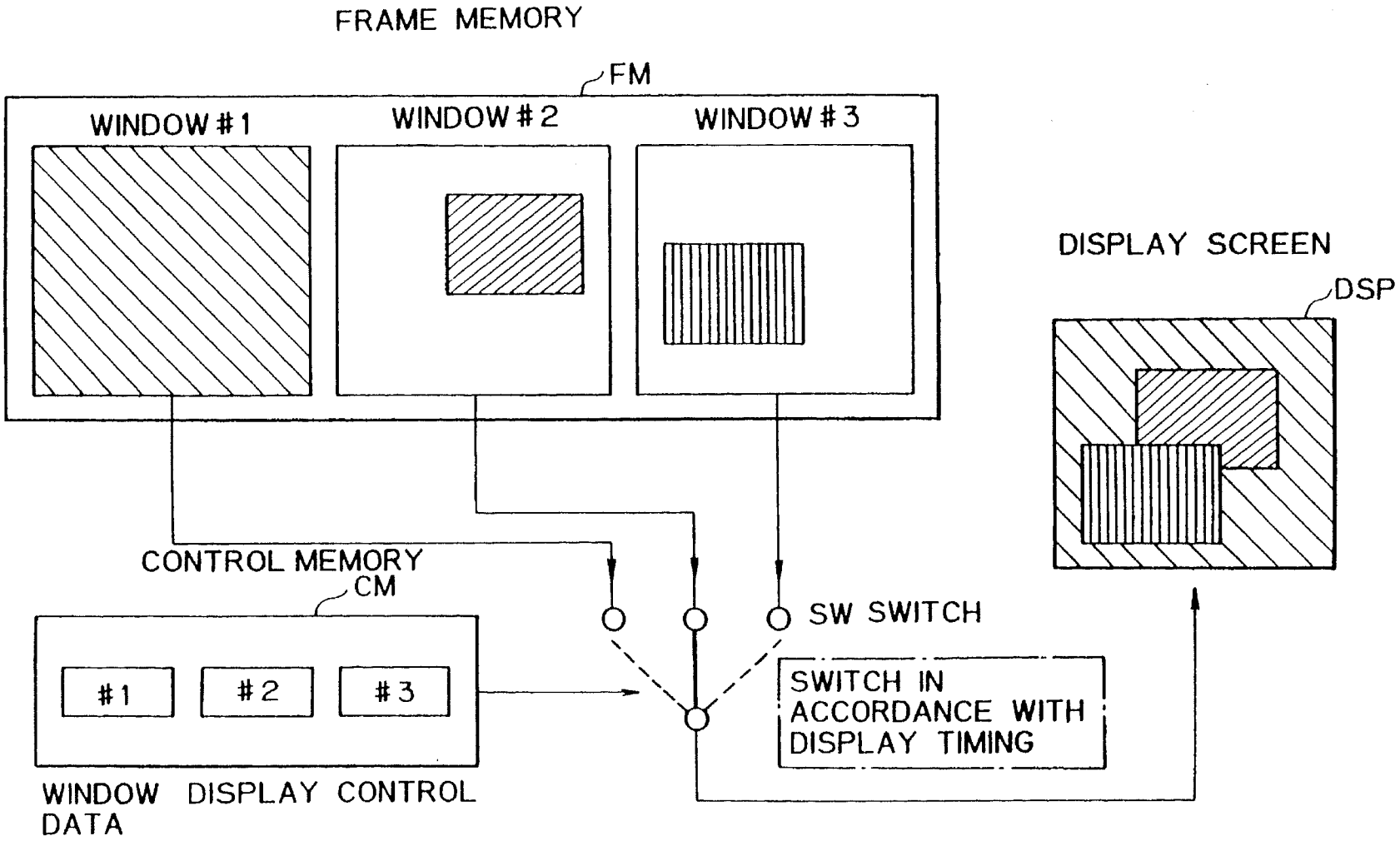
Fig. 23 PRIOR ART
FIG. 23 is a diagram showing an example of a conventional hardware window system.

In FIG. 23, the conventional hardware window system has a single frame memory FM having a capacity to display a larger region than the region to be displayed. Alternatively, the system may have a plurality of frame memories each having a window with a capacity equal to the region to be displayed. A plurality of windows #1, #2, and #3 are stored in the frame memory FM shown in FIG. 23, and each window has the same size as the region to be displayed. Each window stores pixel data to be displayed as shown by dots or slash lines in FIG. 23 and a multiwindow display screen image is obtained by reading data of each window from the frame memory FM in synchronization with a raster scan of a CRT (cathode ray tube) display screen DSP, and by synthesizing the read data by hardware.

A control memory CM is provided to control the reading operation, and window display control data such as a storage location of each window, display location of each window on the CRT display screen DSP, display priorities of the windows when overlapped, and so forth, are set in the control memory CM. In the example shown in FIG. 23, the window #3 has the highest priority and the window #1 has the lowest priority, when these windows #1 to #3 are overlappingly displayed simultaneously on the CRT display screen DSP. The control memory CM controls a switch SW connected to the windows #1 to #3 so that the windows are displayed on the CRT display screen DSP. The control of the switching is effected in accordance with display clock signals obtained from the storing location, the display location, and the overlapping priority of each window.

Therefore, in the conventional hardware window system, it is sufficient to set the necessary window display control data in hardware corresponding to the respective windows, and thus an advantage of a high speed display switching capability is obtained.

Figure 24A:
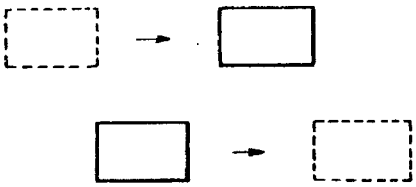
Fig. 24A PRIOR ART
FIGS. 24A to 24D are diagrams explaining conventional basic window display operations.
Figure 24C:
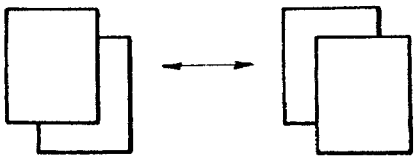
Fig. 24C PRIOR ART
Figure 24B:
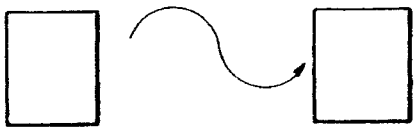
Fig. 24B PRIOR ART
Figure 24D:
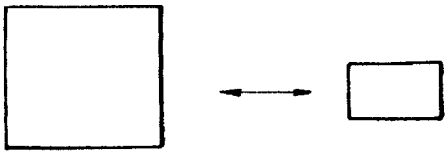
Fig. 24D PRIOR ART
Figures 25A, 25B, 25C, 25D:
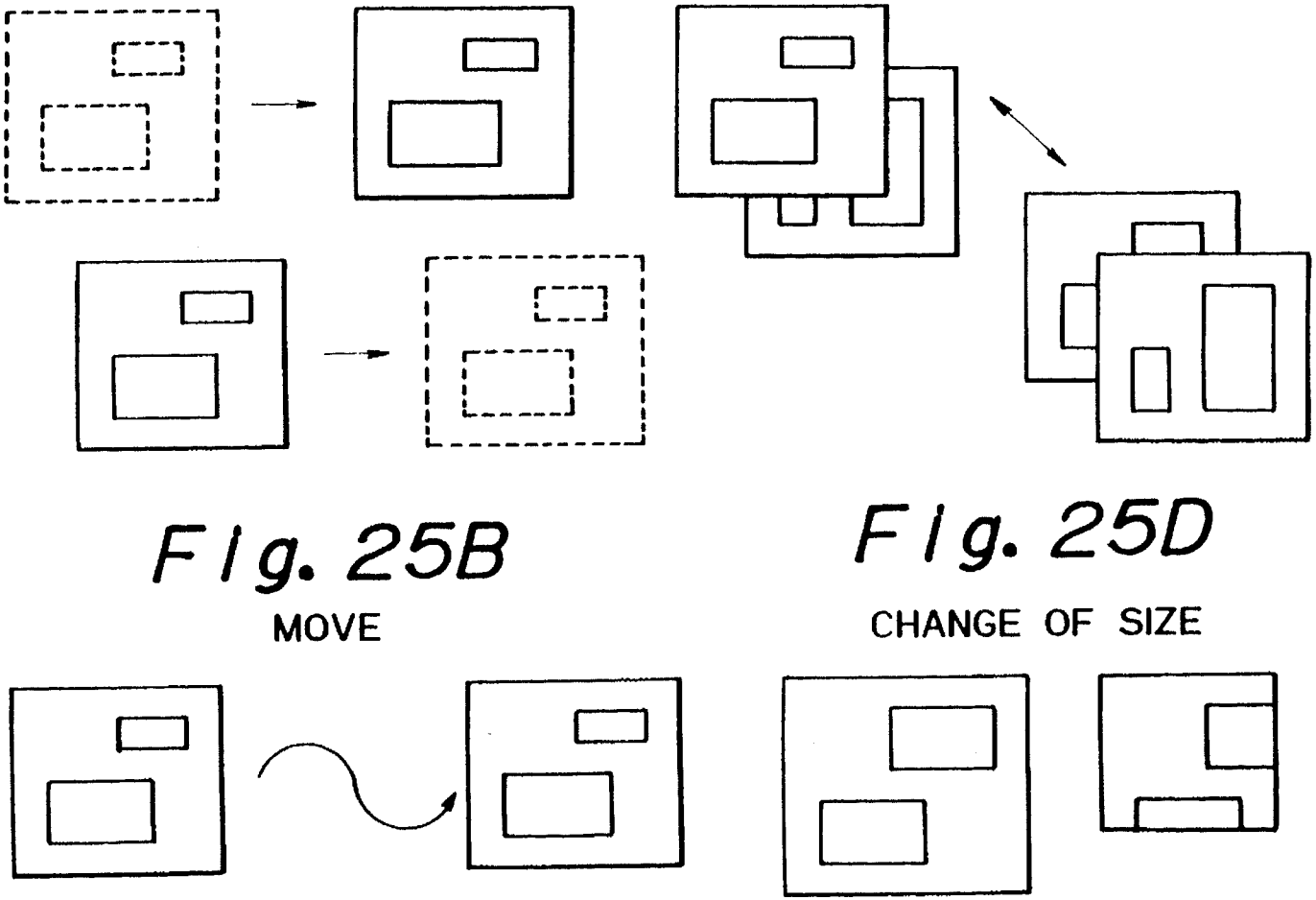
FIGS. 25A to 25D are diagrams showing group window basic operations for explaining the subject of the present invention.

In the above-mentioned conventional example, the basic operations as shown in FIGS. 24A to 24D, i.e., the basic operations such as a generation/erasing of a window as shown in FIG. 24A, a movement of a window as shown in FIG. 24B, a change of an overlapping as shown in FIG. 24C, or a change of the size of a window as shown in FIG. 24D, can be carried out.

Nevertheless, when a plurality of windows are to be treated as one group of windows, as shown in FIGS. 25A to 25D, it is not easy to carry out the generation/erasing, movement, change of overlapping, or change of the size of the group of windows. This causes a problem in that, due to the high degree of human interface now required, there is a need for a high degree of freedom or efficiency of operation for linking a plurality of groups of windows where each group itself includes a plurality of windows, to accomplish a page movement or page turning operation as shown in FIGS. 26A to 26C.

Figure 26A:
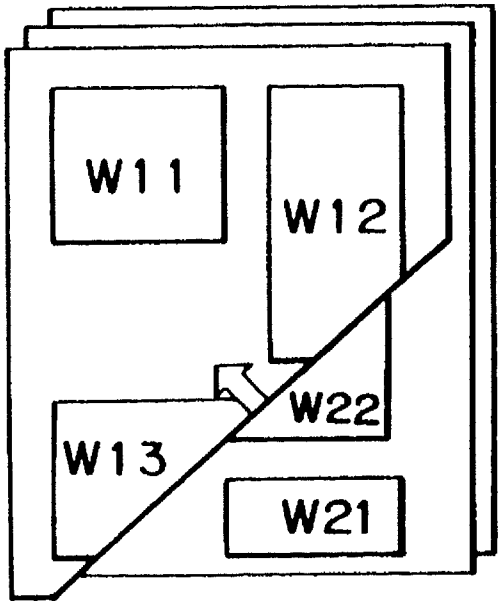
FIGS. 26A to 26C are diagrams showing a page turning operation which is an applied example of the group window basic operation.
Figure 26B:
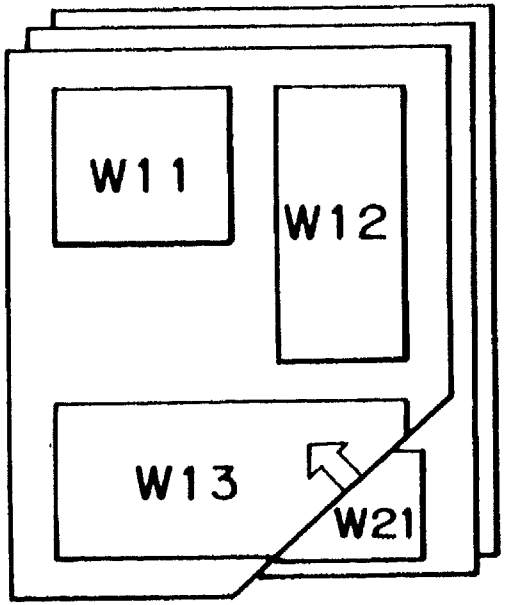
Figure 26C:
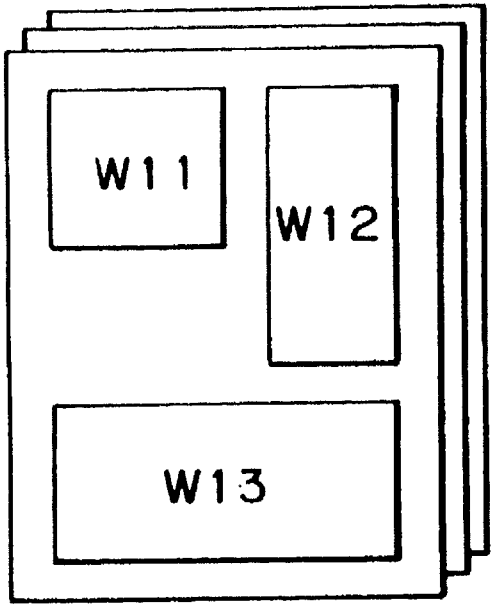

In the page turning operation shown in FIGS. 26A to 26C, a plurality of windows W11 to W13 are included in one group of windows, and windows W21, W22, . . . are included in another group of windows. These groups of windows are assumed to be pages of a book, and by turning the page including the windows W11 to W13 through a touch panel or a mouse, the next page including the windows W21, W22, . . . is partially and gradually displayed as the previous page is turned. This page turning operation is similar to the actual turning of the pages of a book.

Figure 1:
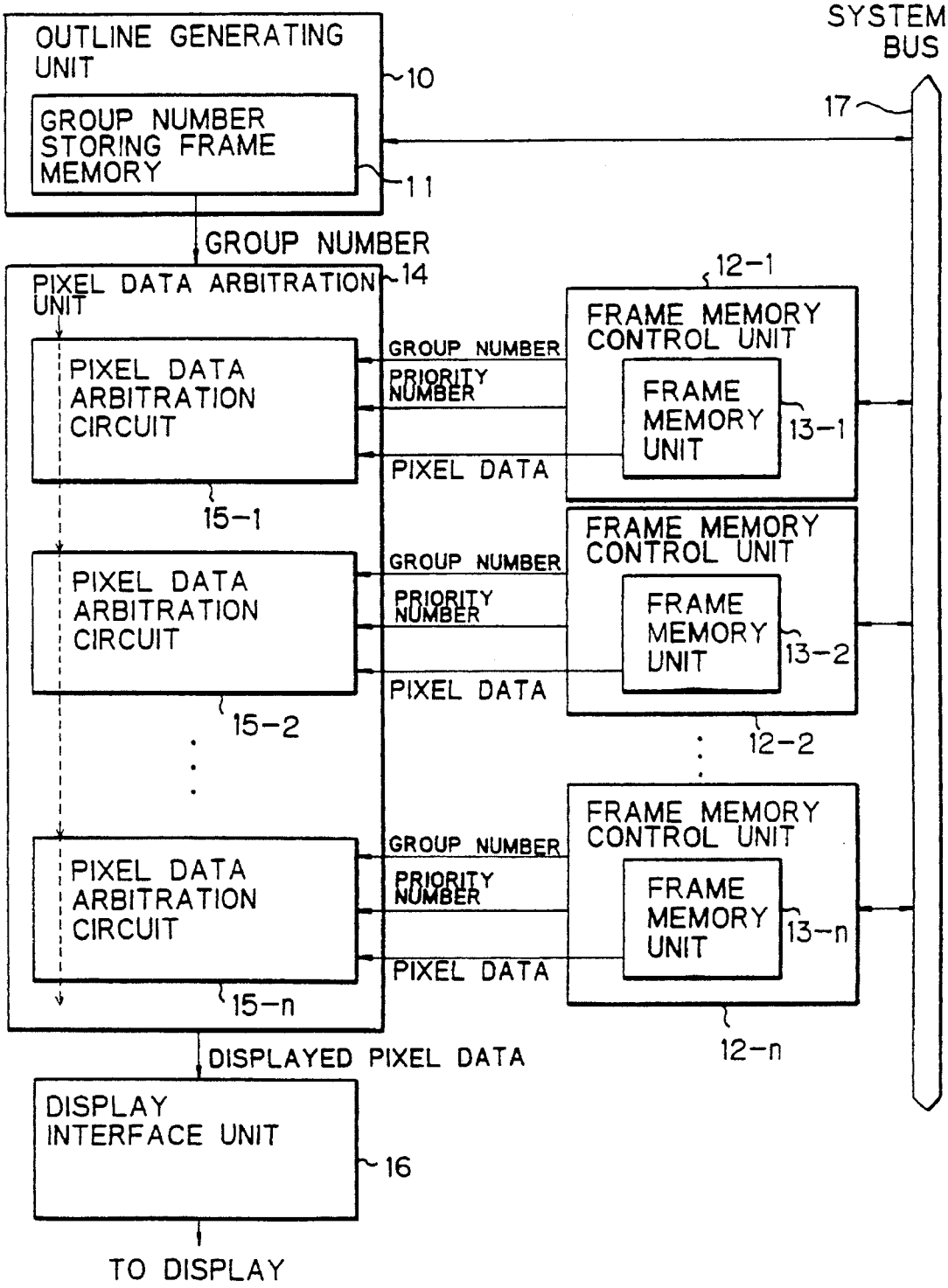
FIG. 1 is a principle block diagram of a multiwindow display control apparatus according to the present invention.

FIG. 1 is a block diagram showing a principle of a multiwindow display control apparatus according to the present invention.

In the multiwindow display control method according to the present invention, two kinds of variables are employed for controlling an overlapping display of a group of windows. These two kinds of variables are group numbers each identifying a group of windows each group including a plurality of windows, and priority numbers each indicating the display order for the windows in the same group of windows (e.g., windows located on the same page) when the windows are to be overlappingly displayed. The overlapping display control is carried out by a combination of the group number and the priority number. Namely, a plurality of windows are grouped by a group number; the group to be displayed in each pixel region on the display screen is determined in accordance with the group number; and the overlapping control of the windows is carried out in accordance with the priority number thereof in each group of windows.

The multiwindow display control apparatus according to the present invention illustrated in FIG. 1 comprises an outline generating unit 10 for generating the group numbers for identifying a plurality of windows, a plurality of frame memory control units 12-1 to 12-n each frame memory control unit storing pixel data to be displayed on the corresponding window, a pixel data arbitration unit 14 for selecting, based on the combination of a group number and a priority number indicating the order of the overlapping display in the same group of windows, picture data output from these frame memory control units 12-1 to 12-n, and a display interface unit 16 for providing an interface with a display screen.

A processor for effecting data processing, a main memory, various peripheral units and so forth, not shown in FIG. 1, are connected to a system bus 17.

The outline generating unit 10 generates, each time a pixel is to be displayed and under the control of the processor through the system bus 17, a group number which is the first variable indicating that a plurality of windows in the group of windows are to be treated as one group. To this end, the outline generating unit 10 has a group number storing frame memory 11 for storing the group numbers corresponding, for example, to respective pixels. Alternatively, instead of the group number storing frame memory 11, the outline generating unit 10 may have a control register for individually generating a group number region for each group of windows, by setting data in the control register as later described with reference to FIG. 9.

Each of the frame memory control units 12-i (i=1 to n) includes a frame memory unit 13-i (i=1 to n) which stores pixel data of one of the windows. Data indicating the group number and the priority number of the window is set in a group number register and a priority number register (see FIG. 4) in the frame memory control unit 12-i, by a processor through the system bus 17.

The outline generating unit 10 generates a group number of a group of windows to be displayed on the display for each pixel. Each frame memory control unit 12-i outputs a group number belonging to each group of windows, a priority number indicating the display priority order in the same group, and pixel data. Optionally, the frame memory control unit 12-i also generates a display enable range of a window and so forth.

The pixel data arbitration unit 14 comprises pixel data arbitration circuits 15-i (i=1 to n) corresponding to the respective frame memory control units 12-i. Each picture pixel data arbitration circuit 15-i determines, for each pixel, whether or not the group number generated by the outline generating unit 10 coincides with the group number output from the frame memory control unit 12-i, and further, compares the priority number output from the frame memory control units 12-i belonging to the same group, as later described in more detail with reference to FIGS. 15 to 21. Accordingly, the pixel data output from the frame memory control units are arbitrated or compared by the pixel data arbitration circuits 15-i so that pixel data of one selected frame memory unit 13-i is output from the .pixel data arbitration unit 14 to display interface unit 16.

The display interface unit 16 converts the pixel data output from the pixel data arbitration unit 14 into display signals.

Note that each of the frame memory control units 12-i may carry out the display position control of each window by using absolute coordinates of the regions corresponding to the display screen, or instead may carry out this control by using relative coordinates with respect to the region occupied by the group of windows.

As will be seen from the above description, according to the present invention, two variables are employed for the window overlapping control, i.e., the window overlapping control is carried out by a combination of a group number and a priority number indicating the order of display priority in the same group.

Accordingly, a plurality of windows can be linked in the same group of windows, and further, desired windows in the same group of windows can be displayed in accordance with the display priorities thereof.

For example, when an operation in which a plurality of windows such as a window for a character text, a window for displaying an image, a window for displaying a moving picture, and so forth are collected and treated as if on one paper, is to be realized, a same group number is provided to these windows, and a priority number is designated to each window. The windows in each group are then linked based on group and priority numbers so that they can be operated as a group of windows, and thus various operations can be carried out by a simple control.

Figures 2A, 2B, 2C:
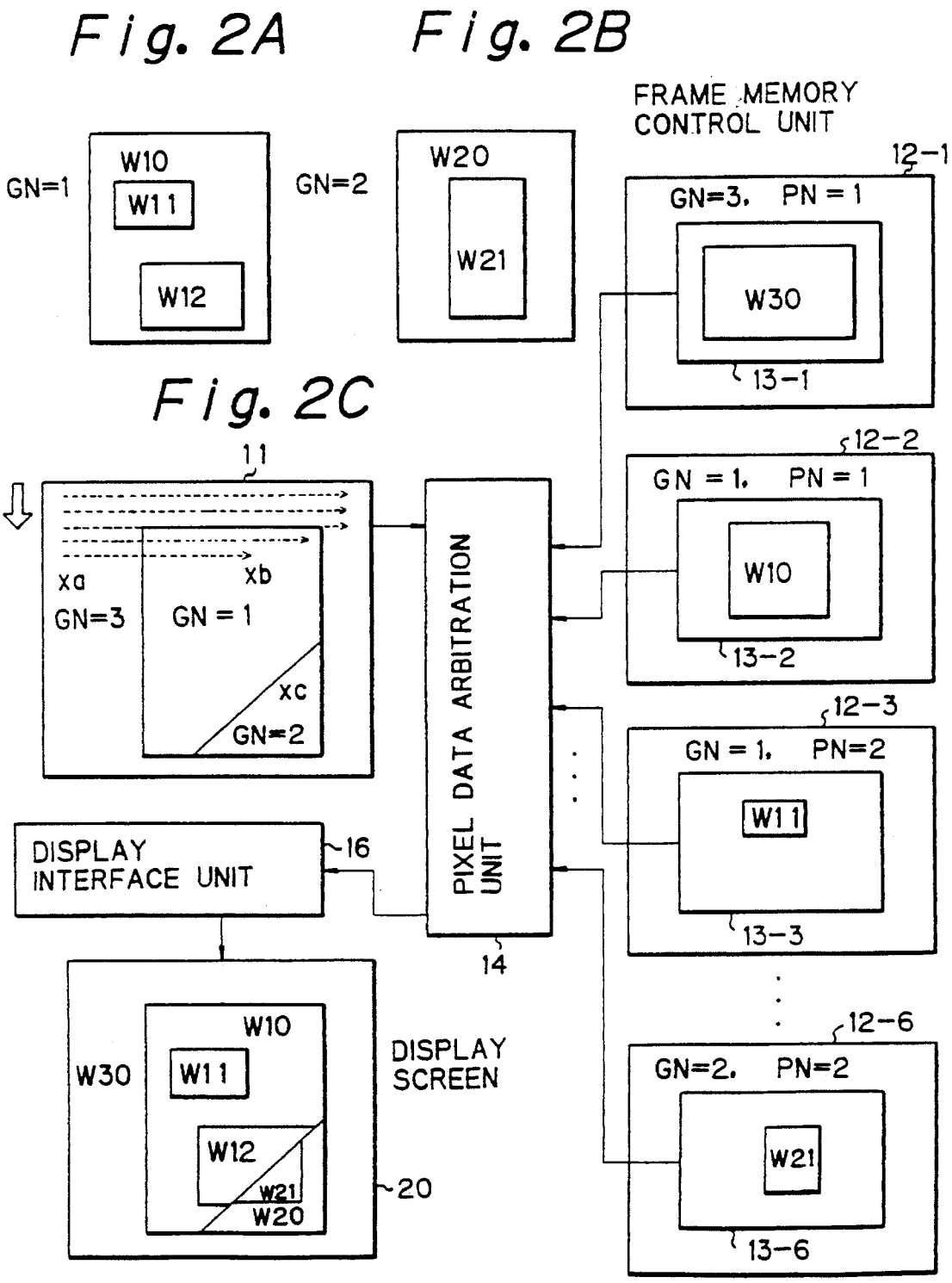
FIGS. 2A to 2C are diagrams explaining a multiwindow display control of the present invention.

FIGS. 2A to 2C are block diagrams showing a multiwindow display control apparatus according to an embodiment of the present invention. Note, throughout the drawings, the same reference numerals and symbols represent the same parts.

Referring to FIGS. 2A to 2C, an explanation is given of an example of realizing a page turning operation in which a first page consists of windows W10, W11, and W12 as shown in FIG. 2A, and a second page consists of windows W20 and W21 as shown in FIG. 2B. These pages are to be overlapped as if they are pages of a book. It is assumed that the background of the overlapping pages is a window W30 in FIG. 2C.

It is also assumed that the group number GN of the windows W10, W11, and W12 is "1", the group number GN of the windows W20 and W21 is "2", and the group number GN of the window W30 is "3".

As shown in FIG. 2C, the pixel data of the respective windows W30 to W21 are stored in the frame memory units 13-i located in the respective frame memory control units 12-i (i=1 to 6). Also, in each frame memory unit, a group number GN and a priority number PN indicating the display priority order in the same group are set. In this example, the larger the priority number PN, the higher the display priority order.

For example, the windows W10 and W11 have the same group number GN=1, and therefore, are included in one group of windows having the group number GN=1. The priority numbers in this group of windows are PN=1 for the window W10 and PN =2 for the window W11. If these windows W10 and W11 are to be overlapped, the window W11 is preferentially displayed because it has a higher priority number than the priority number of the window W10. It should be noted that the frame memory control unit corresponding to the window W12 is omitted from FIG. 2C, for simplicity.

In the group number storing frame memory 11 provided in the outline generating unit 10 shown in FIG. 1, a group number GN is set for each pixel of the subject to be displayed. In the example shown in FIG. 2C, the group number GN of the background part W30 is assumed to be "3", the group number GN for the first page is assumed to be "1", and the group number GN for the next page is assumed to be "2". Therefore, in accordance with the page turning operation as illustrated by an arrow pointing downward in FIG. 2C, the region in which the group number GN is "2" is gradually increased or displayed.

The group number storing frame memory 11 is scanned, as shown in the figure by dotted arrows, synchronously with the raster scan on the display, and the group number GN for each pixel is output from the frame memory 11 to the pixel data arbitration unit 14.

Pixel data, a group number GN, and a priority number PN are always output from the frame memory unit 13-i in each frame memory control unit 12-i to the pixel data arbitration unit 14.

The pixel data arbitration unit 14 selects pixel data which has the highest priority in the outputs of a frame memory control unit 12-i having a group number GN which coincides with the group number GN from the group number storing frame memory 11, and sends the selected pixel data to the display interface unit 16.

For example, at a scanning time point xa in the group number storing frame memory 11, since a group number GN=3 output from the frame memory 11 coincides with the group number output from the frame memory control unit 12-1, and since the priority of the window W30 is highest at the scanning point xa, pixel data of the window W30 stored in the frame memory unit 13-1 is displayed.

At a scanning time point xb, since a group number GN=1 is output from the frame memory 11, pixel data of the corresponding position in the window W10, W11, or W12 is displayed. When an overlapping of these windows occurs, the window having the largest priority number PN is displayed.

Similarly, at a scanning point xc, a group number GN=2 is output from the frame memory 11, and the window W20 or W21 of the second page shown in FIG. 2B is displayed.

Accordingly, by merely setting in the group number storing frame memory 11, by a processor through the system bus 17 of FIG. 1, the group numbers corresponding to the respective pixels for a page turning operation, for example, the page turning operation can be simply realized without effecting a change of the contents of the frame memory units 13-i in the frame memory control units 12-i. Namely, according to the present invention, each of the frame memory units 13-i merely fixedly stores data relating to its own or respective window.

Instead of providing the group number storing frame memory 11 and rewriting the group numbers therein, it is also possible to prepare a plurality of control registers in the outline generating unit 10, as described later in more detail with reference to FIG. 9. In this case, briefly, the control registers are provided to correspond to the respective group numbers, and addresses of the regions of the group of windows are stored in the control registers.

Figure 9:
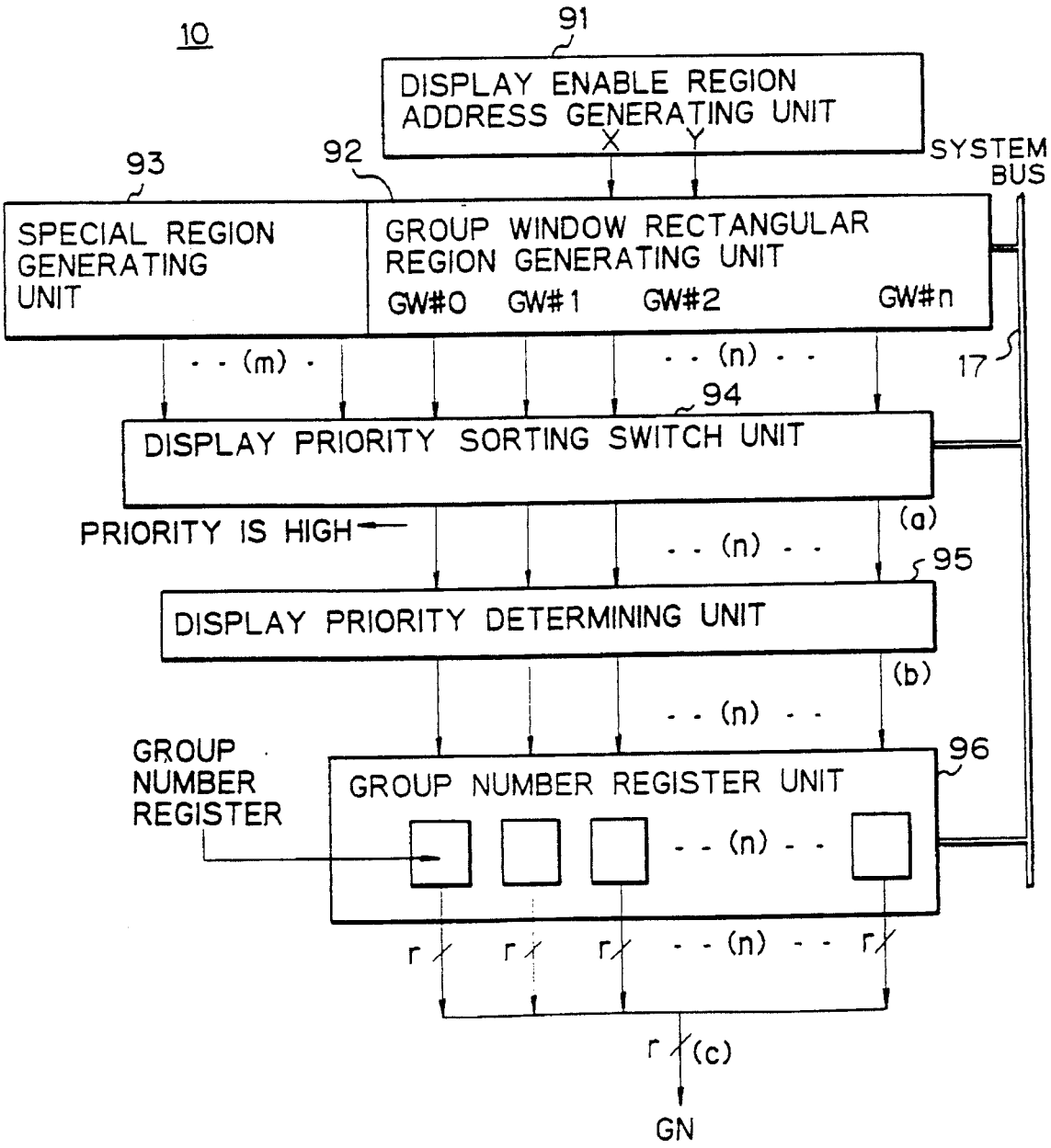
FIG. 9 is a diagram showing another example of the construction of the outline generating unit according to a second embodiment of the present invention.

Thus, signals representing individual group number regions, i.e., the group window rectangular region signals of the regions occupied by a group of windows of the respective group numbers, are generated from the control registers and these group window rectangular region signals are used for outputting the group numbers from the outline generating unit 10 (See FIG. 9).

Figure 3A:
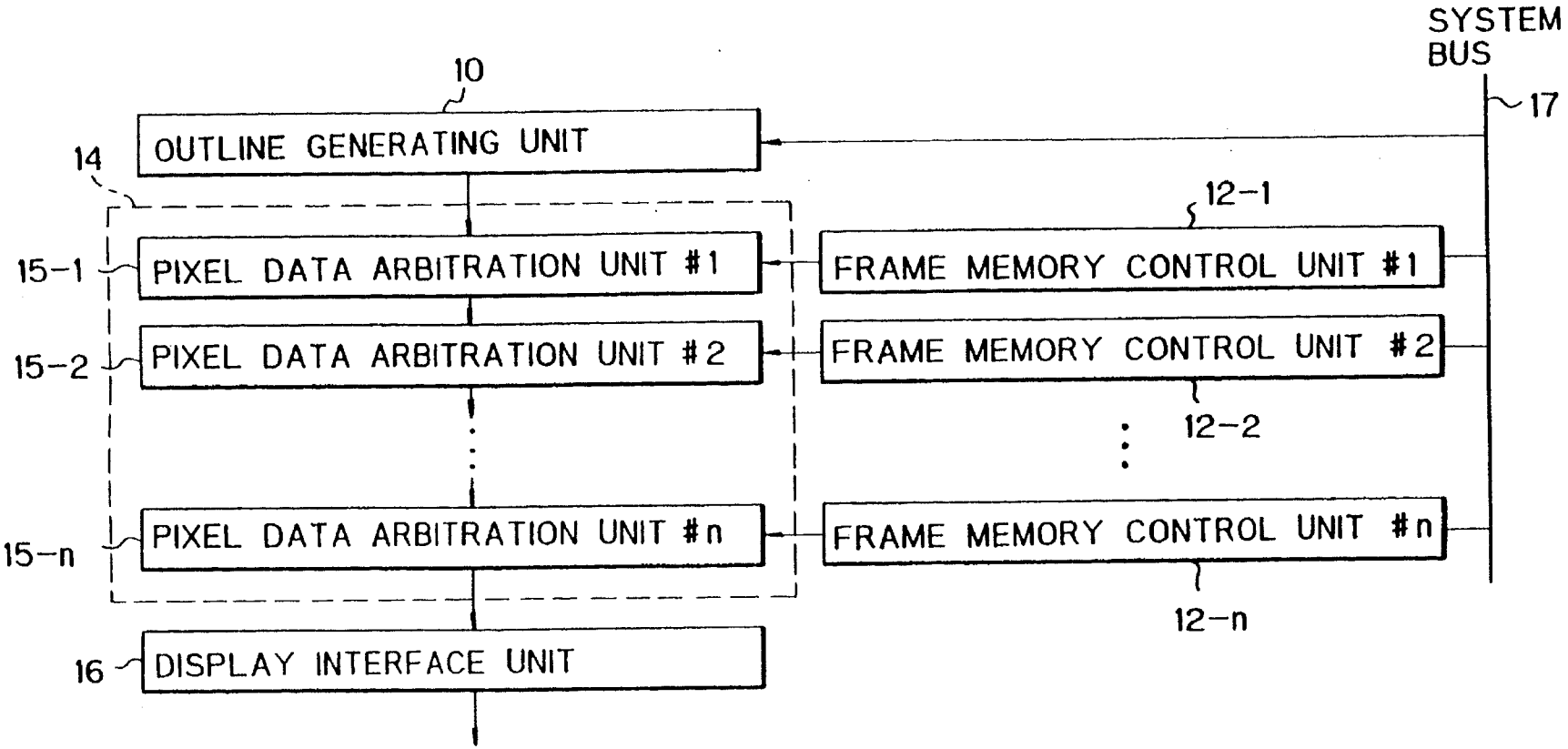
FIG. 3A is a diagram showing a daisy chain connection of pixel data arbitration circuits of the present invention.
Figure 3B:
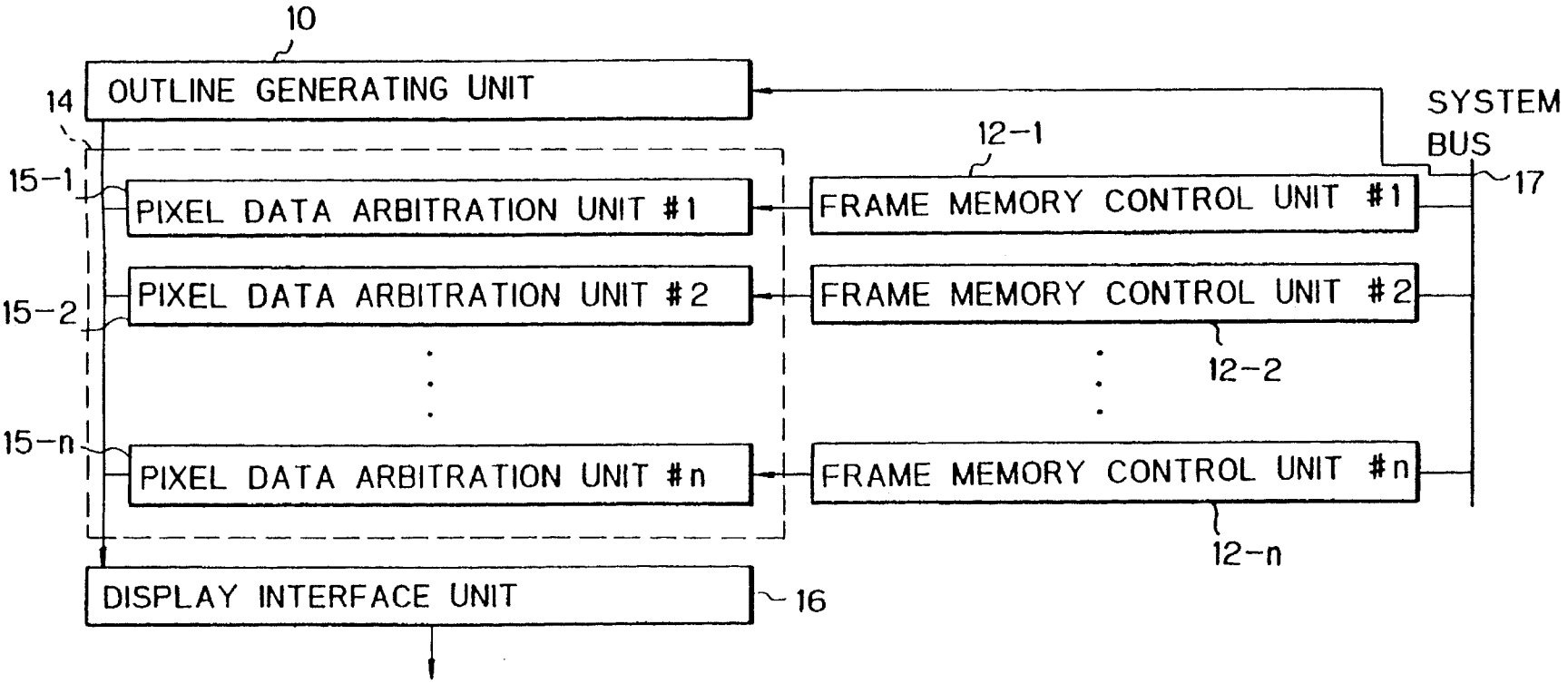
FIG. 3B is a diagram showing a bus connection of pixel data arbitration circuits of the present invention.

The pixel data arbitration unit 14 comprises a plurality of pixel data arbitration circuits 15-i corresponding to the respective frame memory control units 12-i, as shown in FIG. 1. Each of the pixel data arbitration circuits 15-i inputs and outputs a group number signal, a priority number signal, and a pixel data signal. Optionally, each pixel data arbitration circuit 15-i inputs and outputs the group window rectangular region signal. There are two examples relating to the connection of these signal lines. Namely, in one example as shown in FIG. 3A, the pixel data arbitration circuits 15-i are connected by a daisy chain, whereby the outline generating unit 10 only communicates with pixel data arbitration unit #1 15-1. This communication is passed to the appropriate pixel data arbitration unit 15-i through all previous pixel data arbitration units in the chain. In another example, as shown in FIG. 3B, the pixel data arbitration circuits 15-i are connected by a bus whereby outline generating means 10 to communicates with each pixel data arbitration unit 15-i directly.

Also, as a construction of the outline generating unit 10, there are two examples as mentioned before, i.e., one in which the group number storing frame memory 11 is provided, and another example in which control registers are provided for generating the group window region signals.

Further, for a display position control of a window, there are two examples, i.e., one in which the control is carried out by an absolute coordinate on the display screen, and another in which the control is carried out by a relative coordinate with respect to a region occupied by a group of windows.

Still further, the pixel data arbitration circuits 15-i, can be constructed by providing calculators of two systems for calculating picture data to output the calculated result (See FIG. 17), and for displaying a cursor and so forth, a pixel data forcible changing mechanism (See FIG. 18) can be provided.

The present invention can be embodied by combining these various examples.

Figure 8:
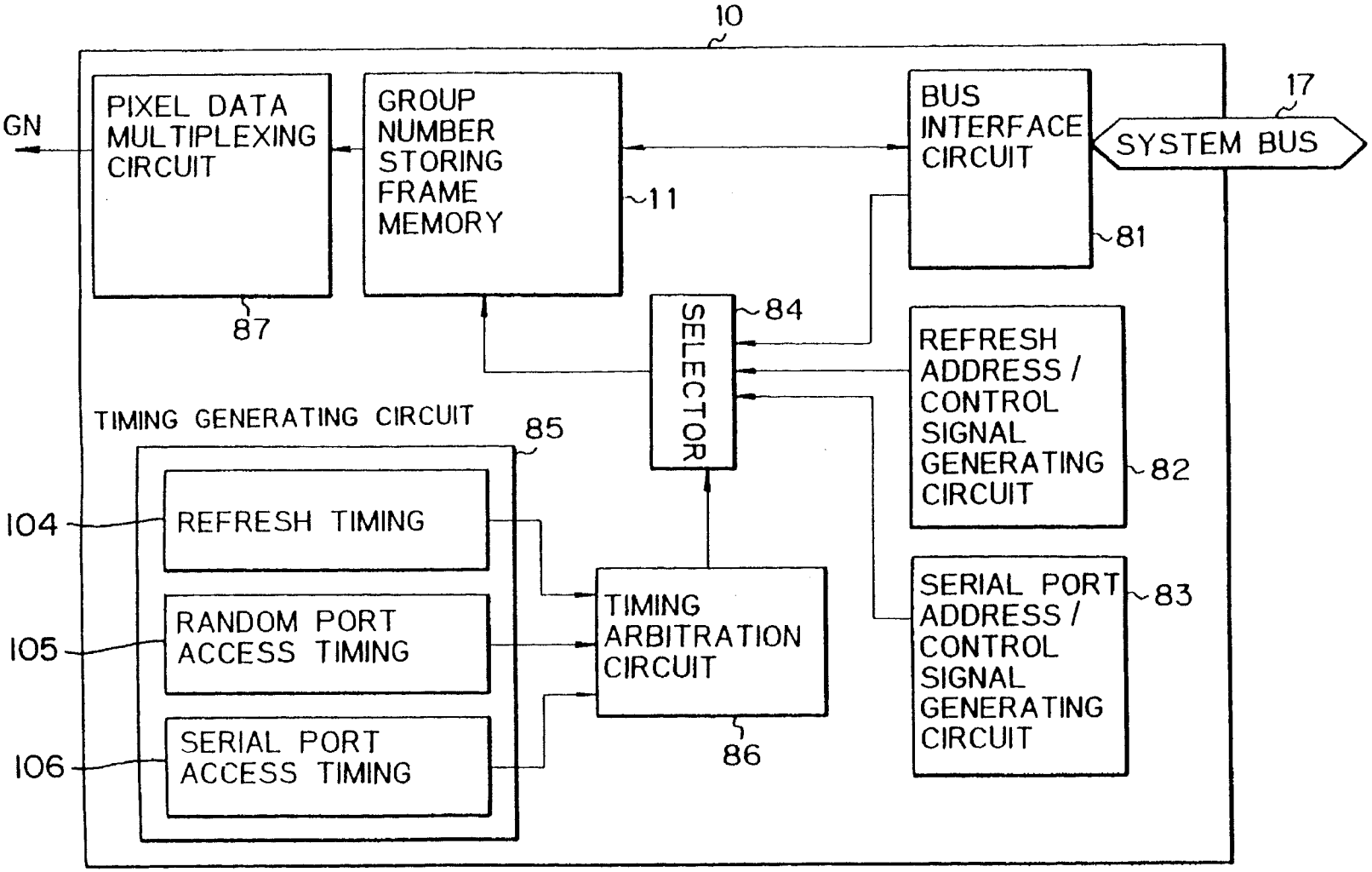
FIG. 8 is a diagram showing an example of the construction of an outline generating unit according to a first embodiment of the present invention.

In the construction of the outline generating unit 10, a first embodiment is shown in FIG. 8 in which the group number storing frame memory 11 is employed for generating the group number signal indicating the group number corresponding to each group window display region, in a state where a plurality of groups of windows each consisting of a plurality of windows are arbitrarily overlapped and displayed on a display.

A second embodiment is shown in FIGS. 9 to 13 in which the group number signal is generated by setting an address in the control register.

Figure 14:
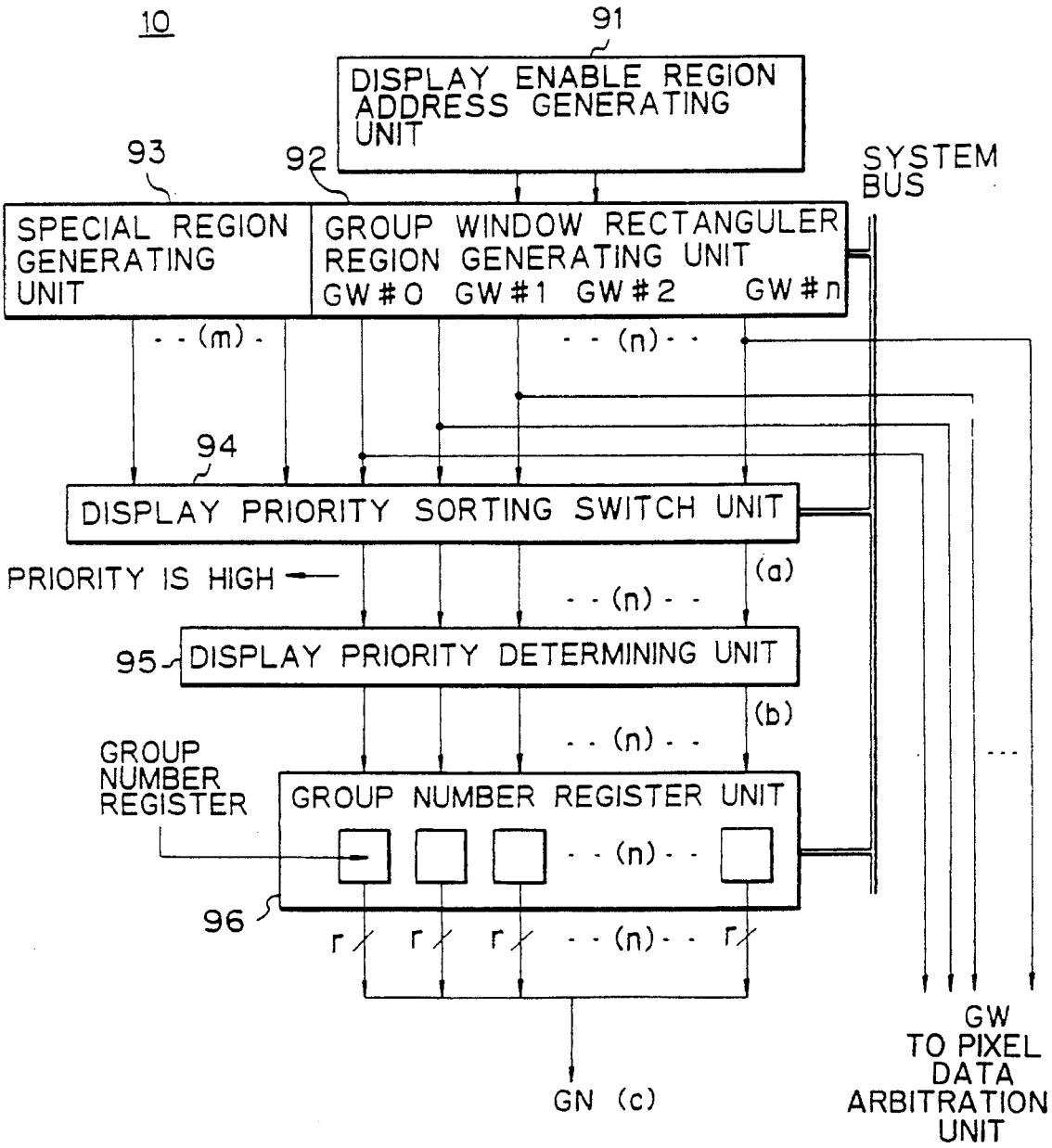
FIG. 14 is a diagram showing another example of the construction of the outline generating unit according to a third embodiment of the present invention.

A third embodiment is shown in FIG. 14 in which the outline generating unit 10 outputs not only the group number signal but also a group window region signal to be used for a display control by a relative coordinate.

Figure 15:
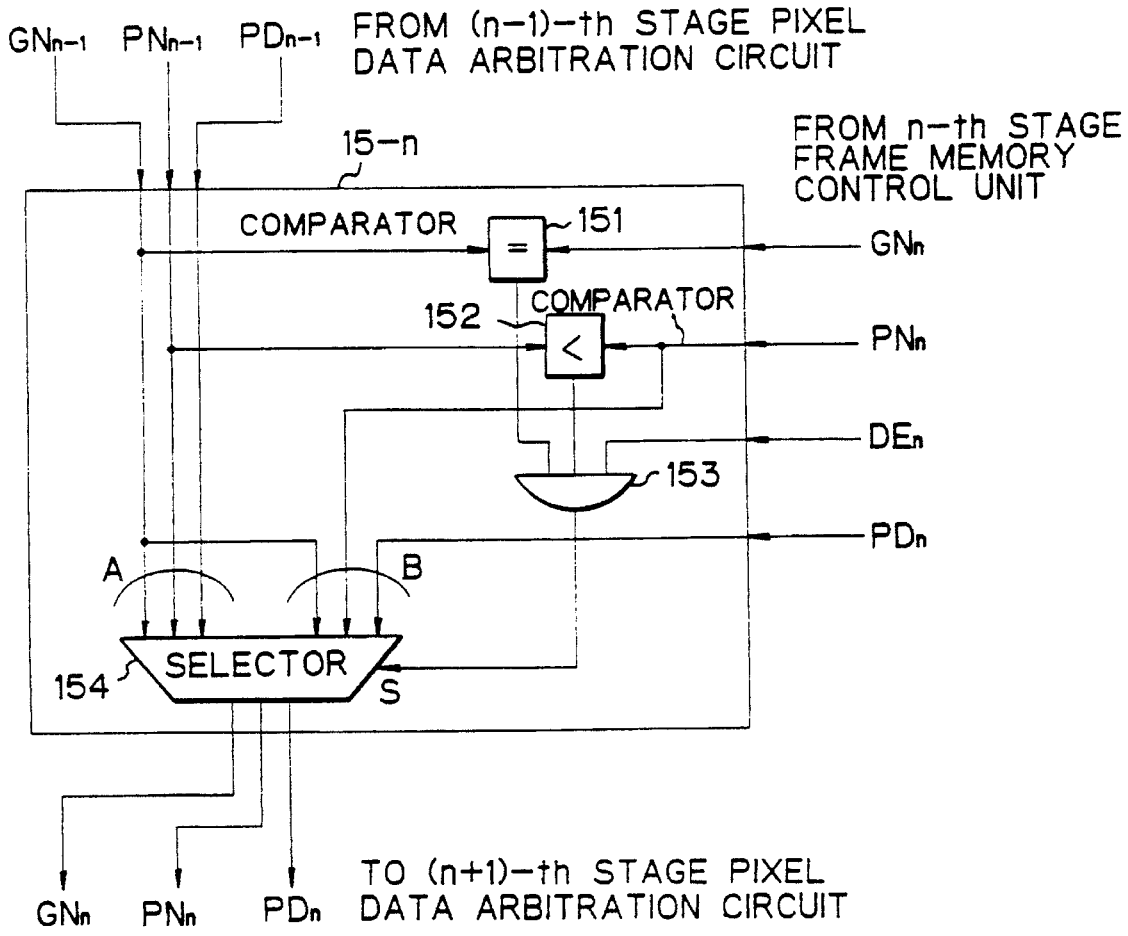
FIG. 15 is a diagram showing an example of the pixel data arbitration circuit according to a fourth embodiment of the present invention.
Figure 16:
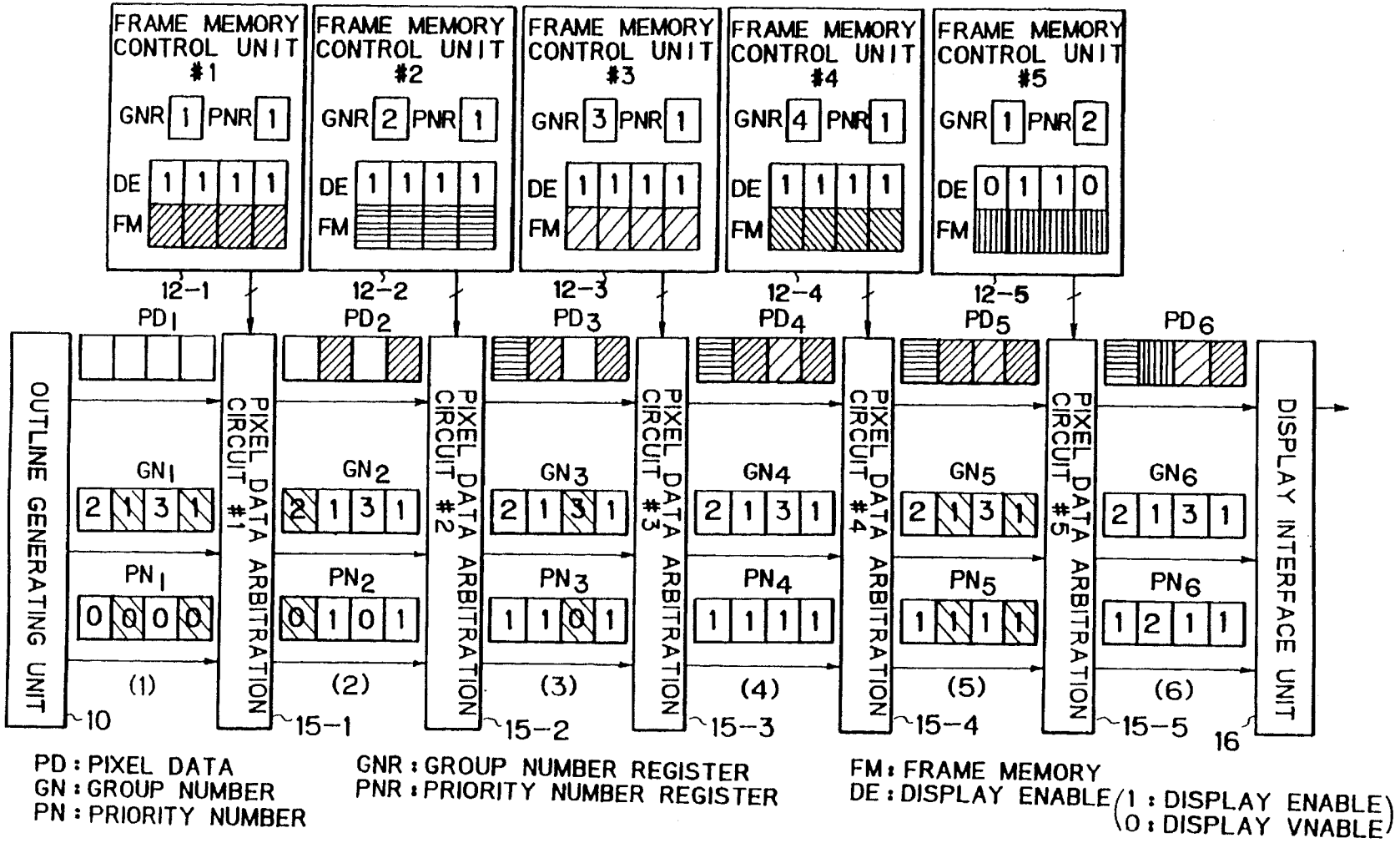
FIG. 16 is a diagram explaining the overall operation of the multiwindow display control apparatus according to a fourth embodiment of the present invention.

A fourth embodiment is shown in FIG. 15 and FIG. 16 in which the pixel data arbitration units 15-i have a daisy chain structure and pixel data of two systems are exchanged.

Figure 17A:
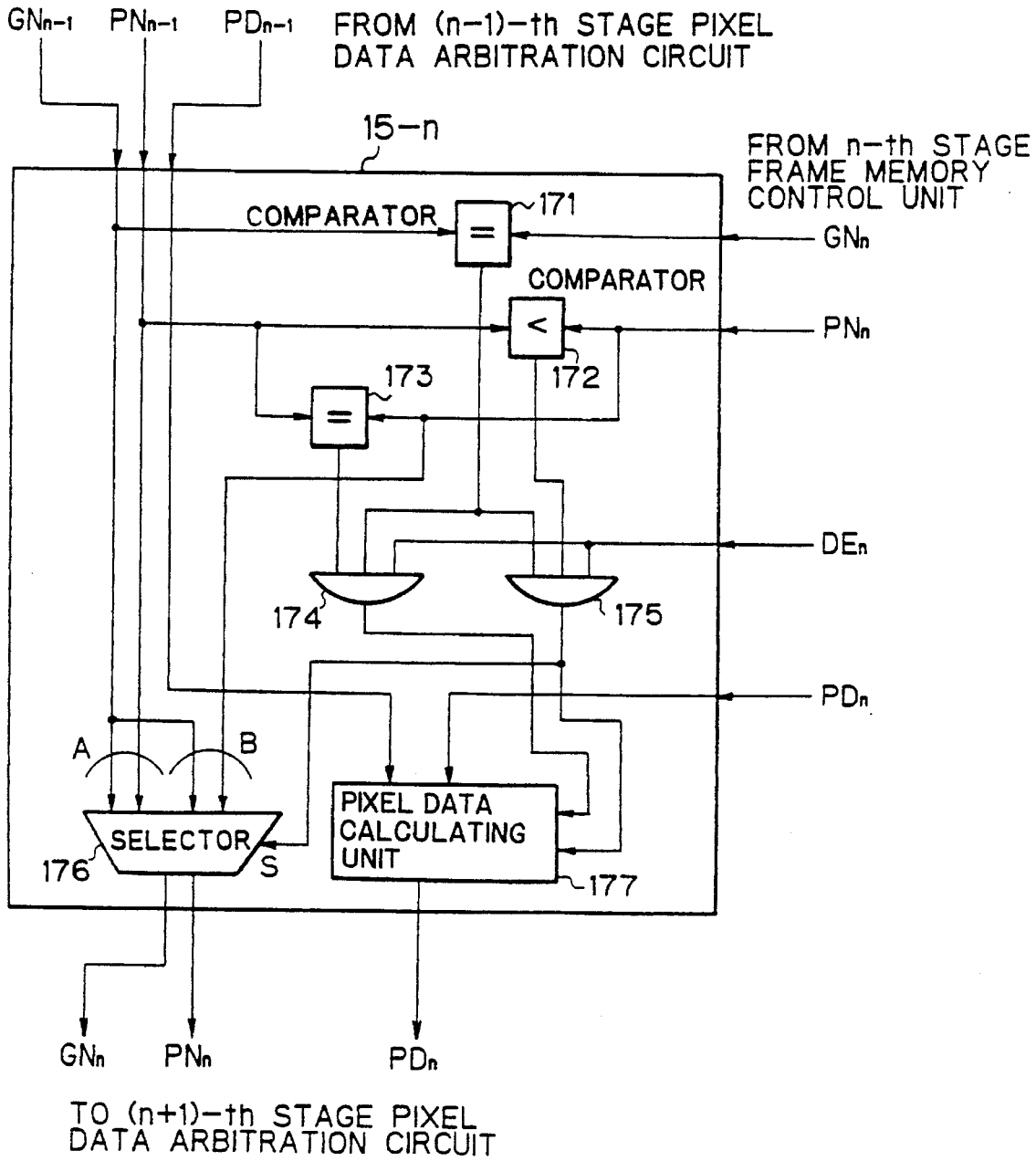
FIGS. 17A and 17B are diagrams showing a fifth embodiment in which a calculating mechanism of pixel data of two systems is added to the fourth embodiment.
Figure 17B:
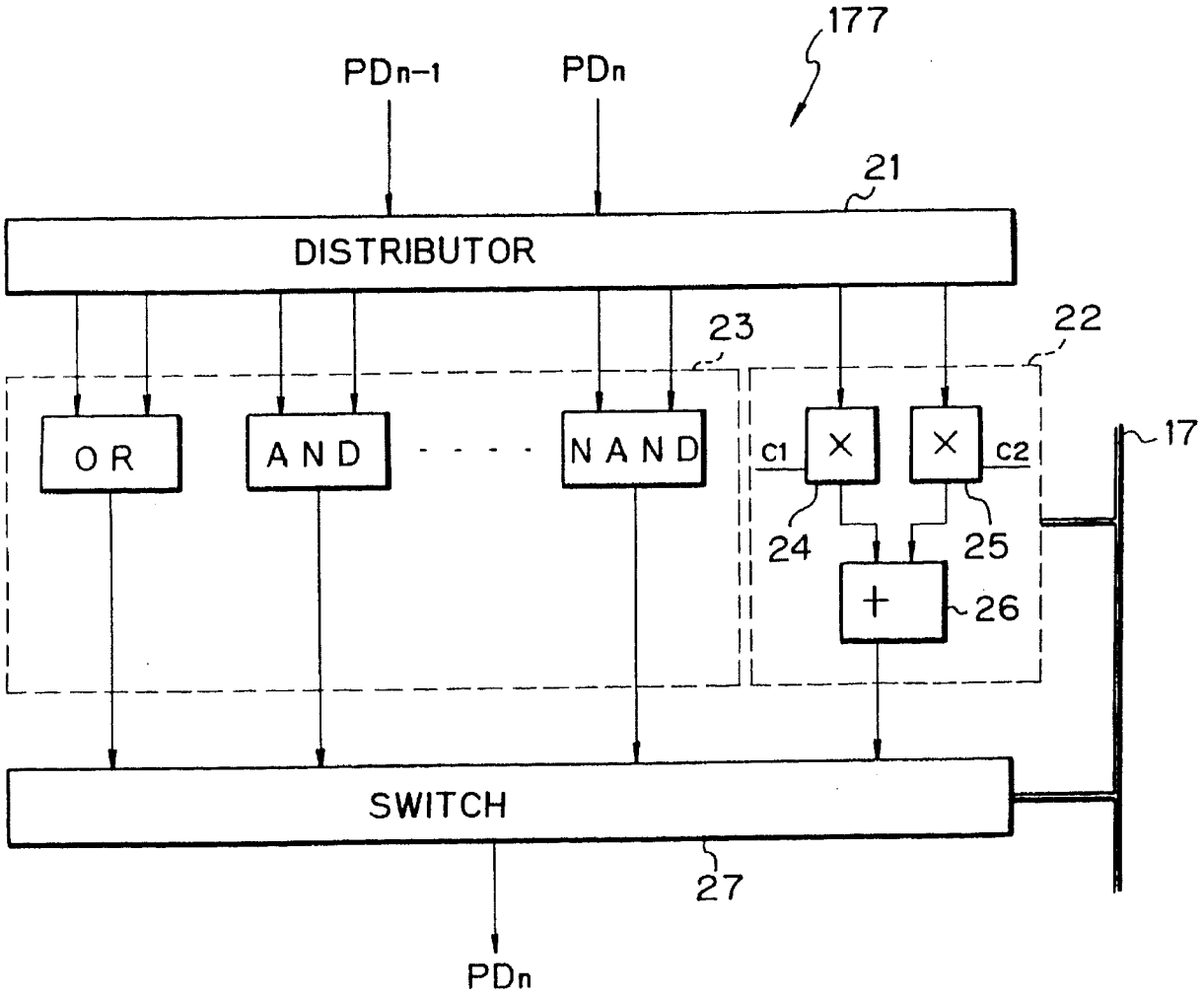

A fifth embodiment is shown in FIGS. 17A and 17B in which a calculating mechanism of pixel data of two systems is added to the fourth embodiment.

Figure 18:
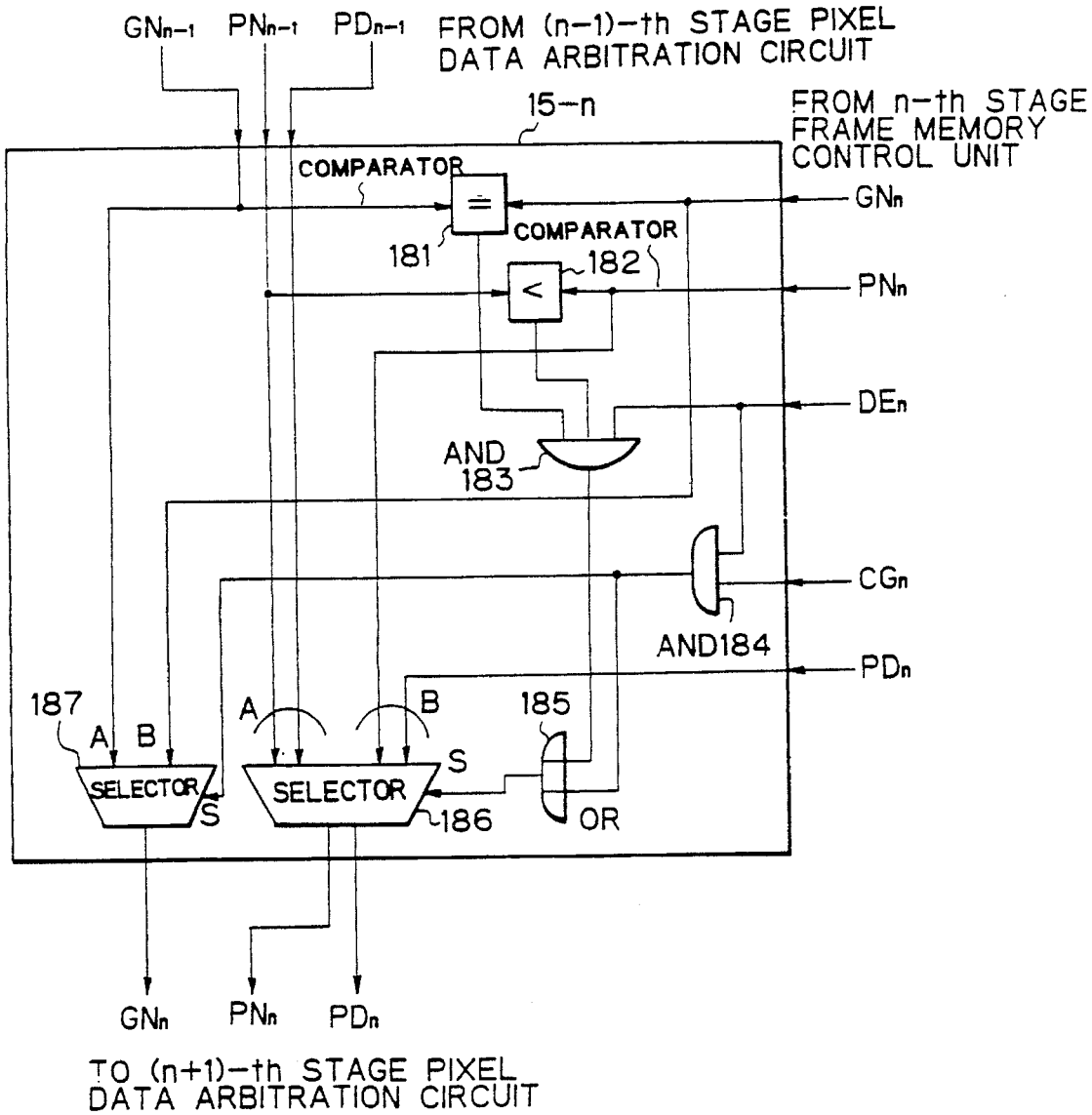
FIG. 18 is a diagram showing a sixth embodiment in which a pixel data forcible changing mechanism may be added to the fourth embodiment or the fifth embodiment.

A sixth embodiment is shown in FIG. 18 in which a pixel data forcible changing mechanism may be added to the fourth embodiment or the fifth embodiment.

Figure 19:
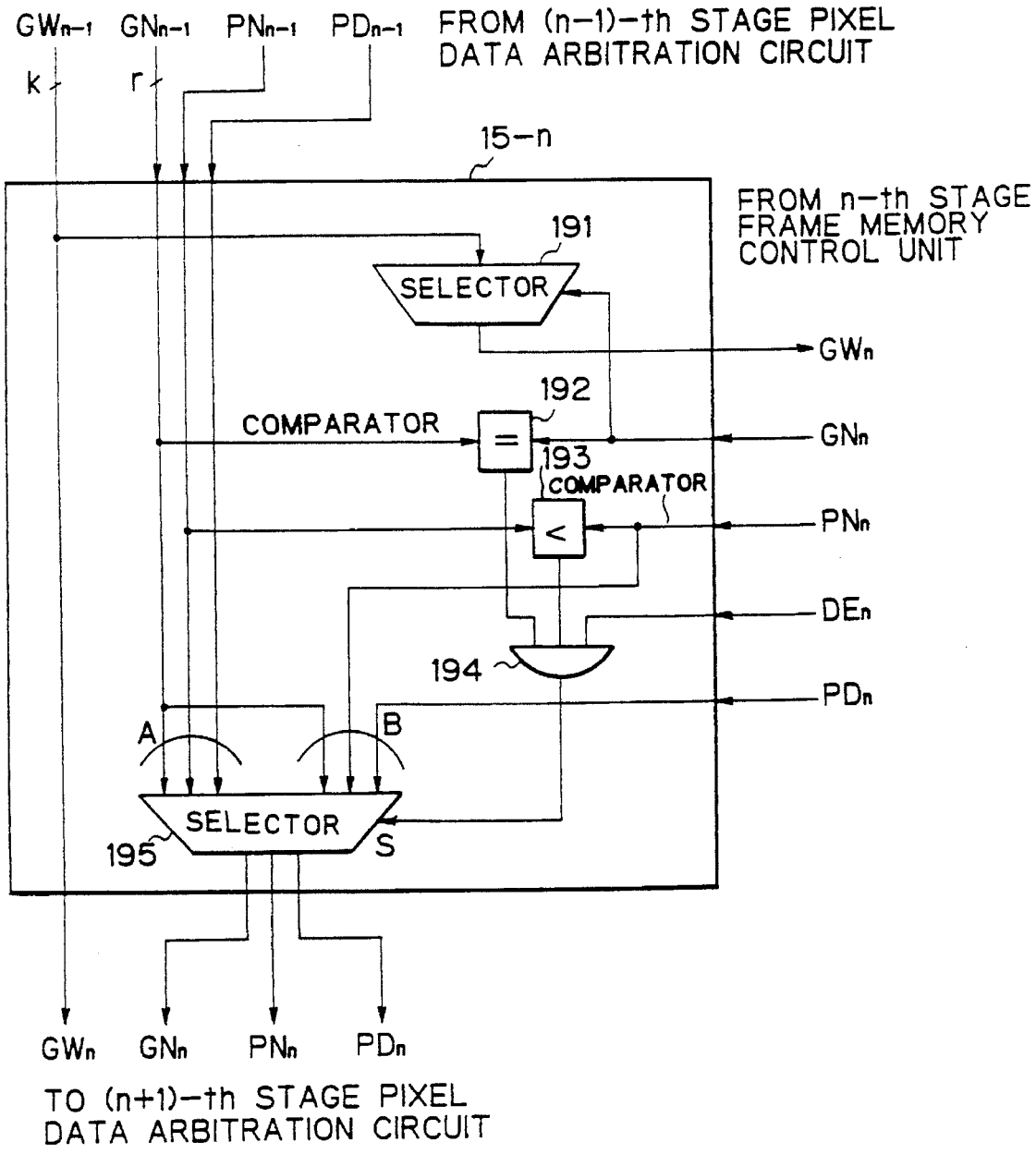
FIG. 19 is a diagram showing a seventh embodiment in which the third embodiment of the outline generating unit 10 and the fourth embodiment of the pixel data arbitration circuit 15-i are combined.

A seventh embodiment is shown in FIG. 19 in which the third embodiment of the outline generating unit 10 and the fourth embodiment of the pixel data arbitration circuit 15-i are combined.

Figure 20:
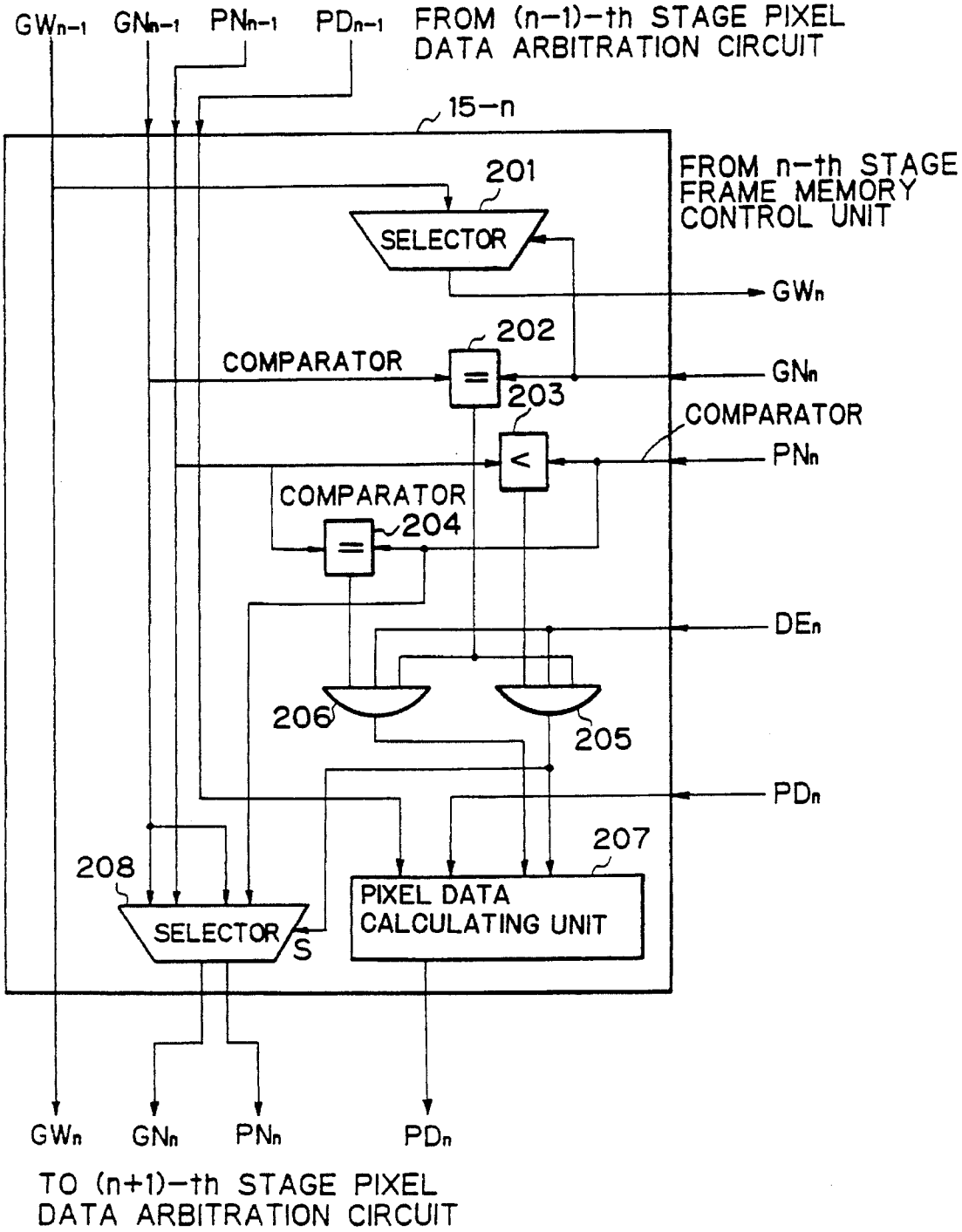
FIG. 20 is a diagram showing an eighth embodiment in which the third embodiment of the outline generating unit 10 and the fifth embodiment of the pixel data arbitration circuit 15-i are combined.

An eighth embodiment is shown in FIG. 20 in which the third embodiment of the outline generating unit 10 and the fifth embodiment of the pixel data arbitration circuit 15-i are combined.

Figure 21:
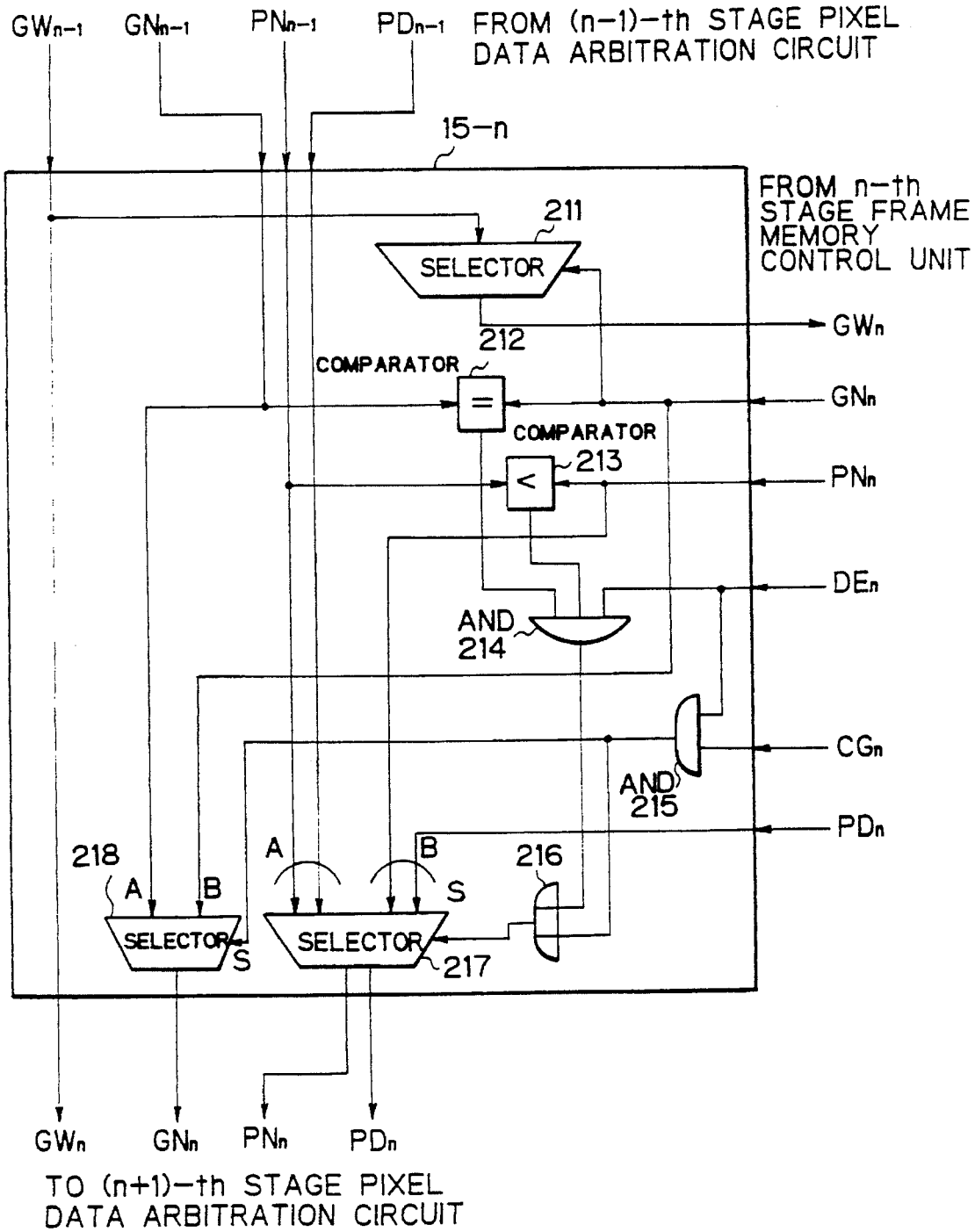
FIG. 21 is a diagram showing a ninth embodiment in which the third embodiment of the outline generating unit 10 and the sixth embodiment of the pixel data arbitration circuit 1-i are combined.

A ninth embodiment is shown in FIG. 21 in which the third embodiment of the outline generating unit 10 and the sixth embodiment of the pixel data arbitration circuit 15-i are combined.

Figure 22A:
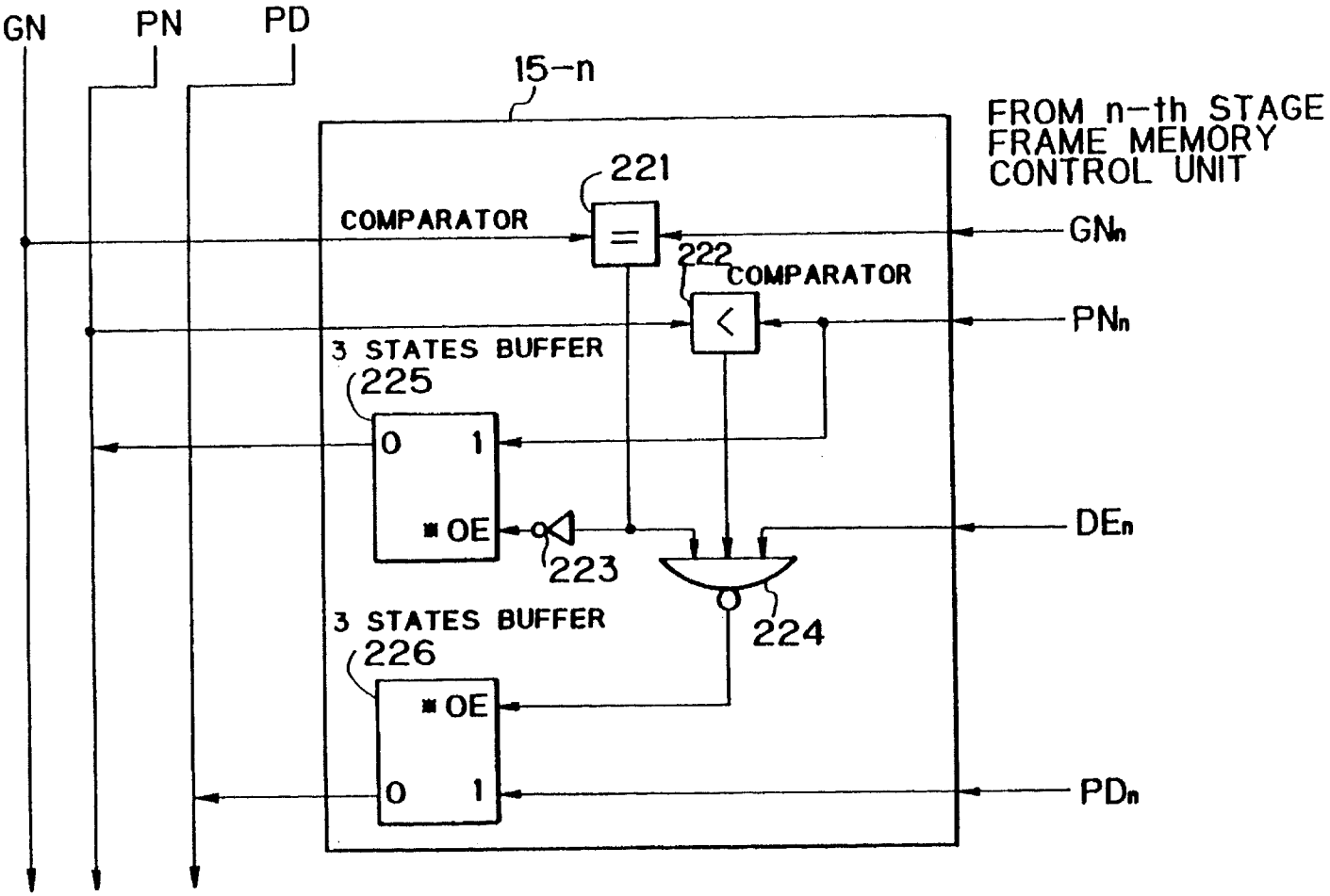
FIGS. 22A and 22B are diagrams showing an example of the pixel data arbitration circuit of a bus structure according to a tenth embodiment of the present invention.
Figure 22B:
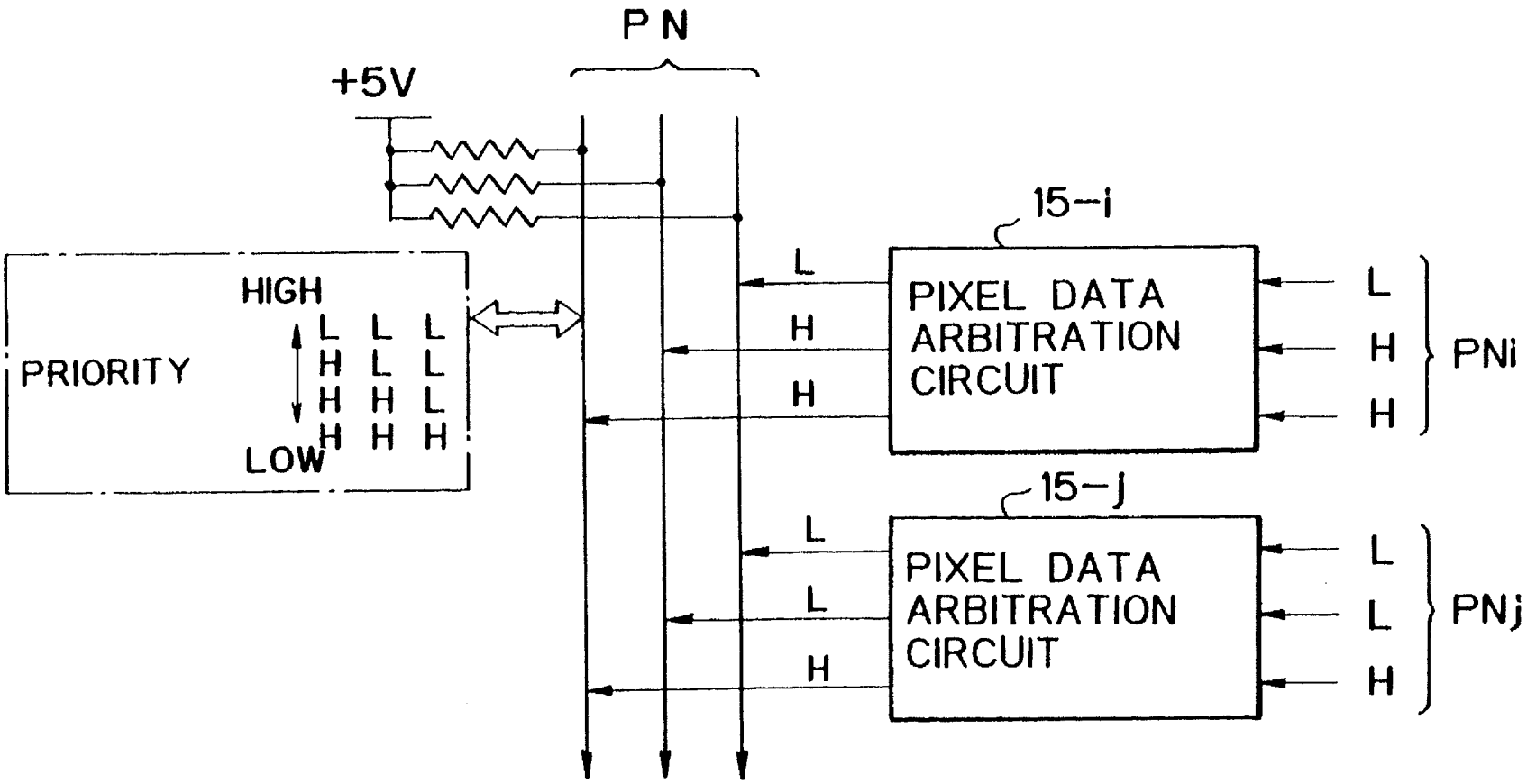

A tenth embodiment is shown in FIGS. 22A and 22B in which the pixel data arbitration circuit 15-i has a bus structure.

First, examples of the constructions of the frame memory control unit 12-i and the display interface unit 16, which are common to these embodiments, are explained with reference to FIGS. 4 to 6.

Examples of the Constructions of the Frame Memory Control Unit 12-i

Figure 4:
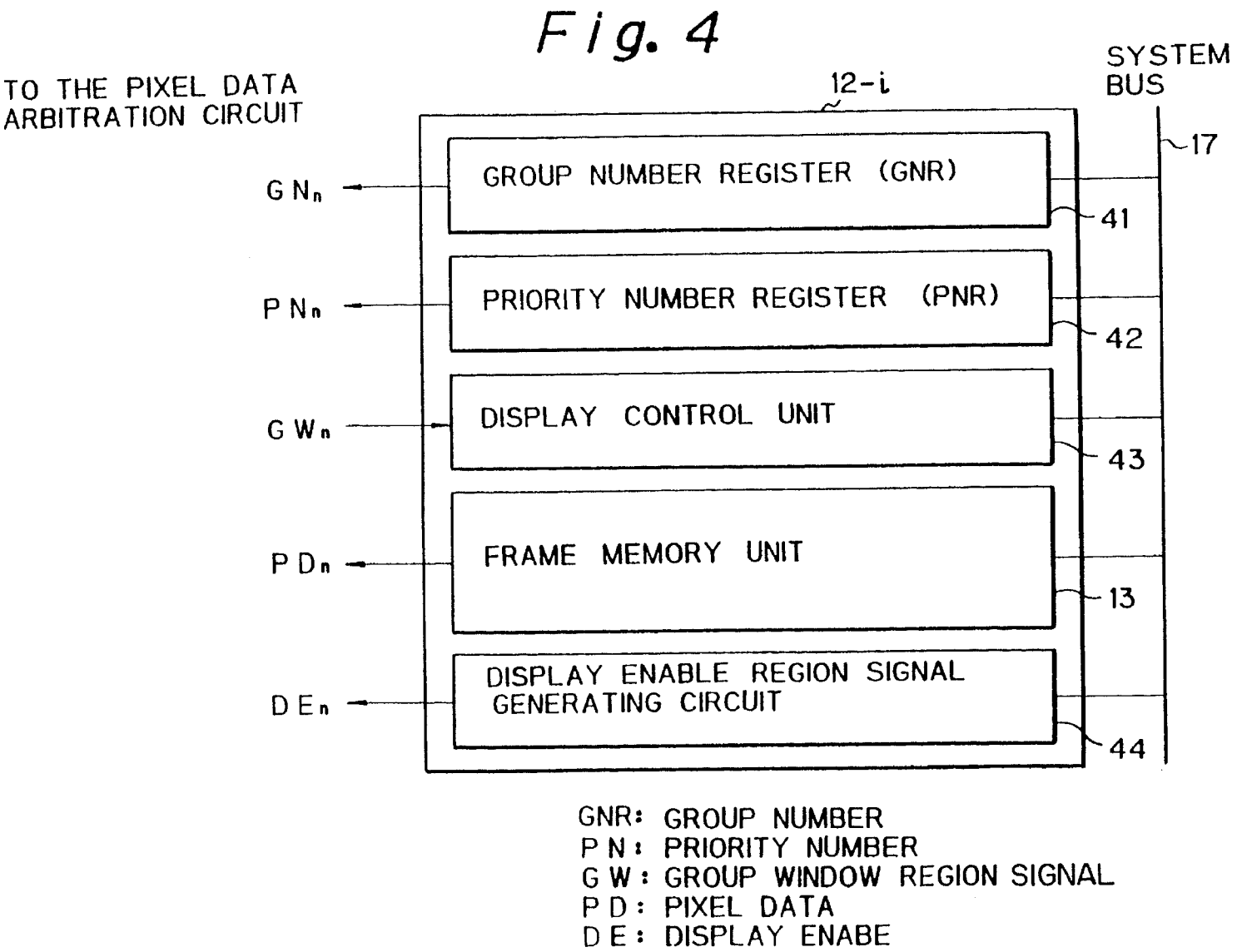
FIG. 4 is a diagram showing the construction of a frame memory control unit of the present invention.

FIG. 4 shows a construction of the frame memory control unit 12-i according to an embodiment of the present invention.

The frame memory control unit 12-i comprises a group number register (GNR) 41 for storing a group number GN allocated to the window corresponding to this frame memory control unit, and a priority number register (PNR) 42 for storing a priority number allocated to the window. In addition, frame memory control unit 12-i includes a display control unit 43, used only when the display is effected by relative coordinates with respect to the group window region on the display screen, for instructing the frame memory unit 13 on the display range and position on the display screen, the frame memory unit 13 for storing pixel data of the window to be displayed on the display. Further, a display enable region signal generating circuit 44 is optionally provided for generating a signal to limit the range actually displayed on the display to an arbitrary shape, in accordance with preset masking data.

Figure 5:
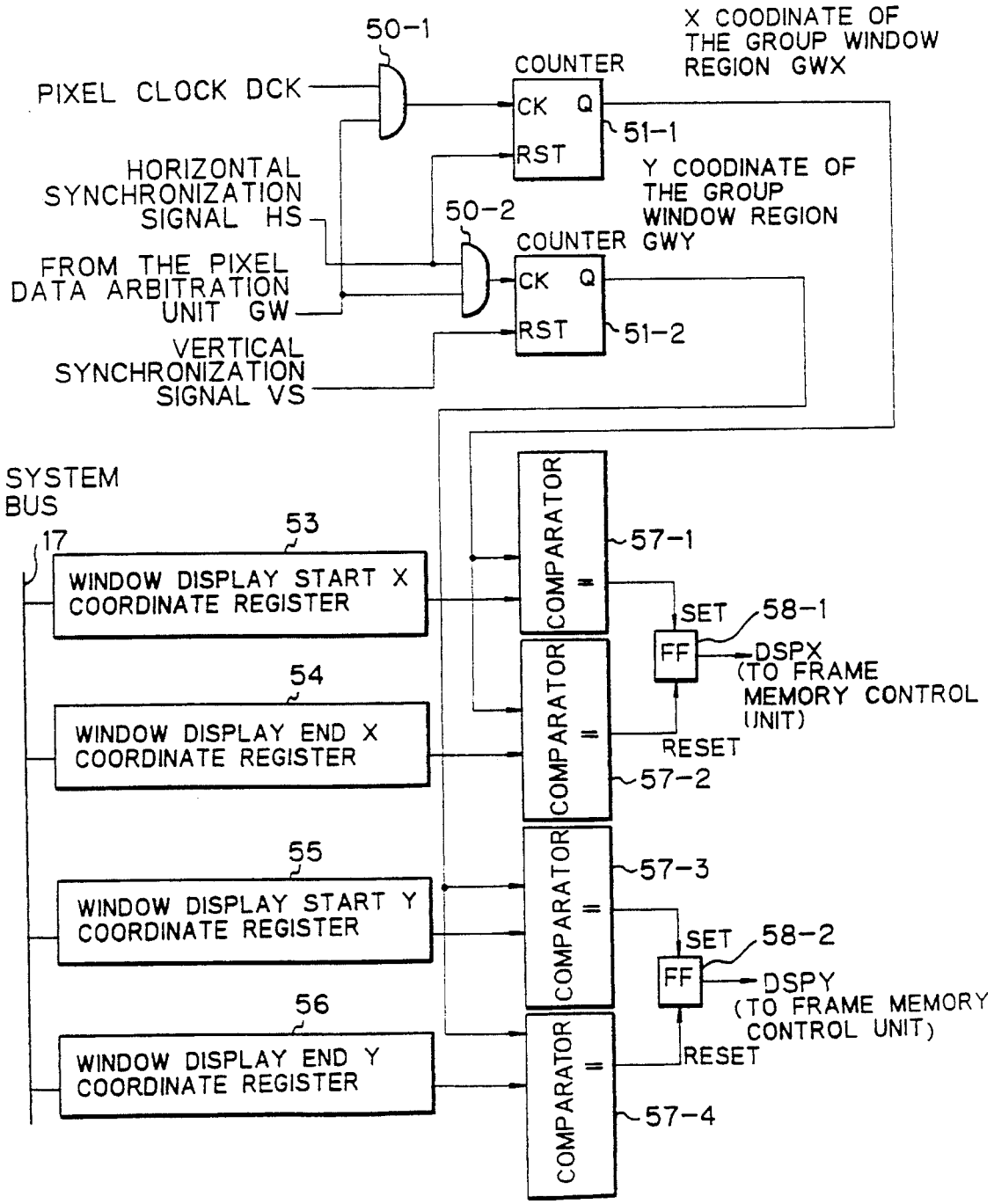
FIG. 5 is a diagram showing the display control unit shown in FIG. 4.

FIG. 5 shows a block diagram of the display control unit 43 shown in FIG. 4. The display control unit 43 in FIG. 5 is used when display position control is carried out using relative coordinates with respect to the group window region.

The display control unit 43 receives a group window region signal GW from the pixel data arbitration unit 14, and based on the group window region signal GW, a horizontal synchronization signal HS, a vertical synchronization signal VS, and a pixel clock signal DCK, signals DSPX and DSPY indicating the range of the group window region in the X direction and in the Y direction are generated.

To this end, there are provided counters 51-1 and 51-2 for counting the group window region signal GW in response to the pixel clock DCK and the horizontal synchronization signal HS through the AND gates 50-1 and 50-2 respectively. The output of the counter 51-1 is the X coordinate GWX of the group window region, and the output of the counter 51-2 is the Y coordinate GWY of the group window region.

In addition, there is provided a window display start X coordinate register 53, a window display end X coordinate register 54, a window display start Y coordinate register 55, and a window display end Y coordinate register 56, connected to the system bus 17. In each of these registers, a start coordinate or an end coordinate of the window handled by the frame memory control unit 12-i is preset.

These outputs and the outputs of the counters 51-1 and 51-2 are compared by comparators 57-1 to 57-4 respectively. When the value GWX coincides with the X start coordinate in the register 53, a flip-flop 58-1 is set. Similarly, when the value GWY coincides with the Y start coordinate in the register 55, a flip flop 58-2 is set. When the values GWX and GWY coincide with the end coordinates in the registers 54 and 56, the flip-flops 58-1 and 58-2 are reset, respectively.

The outputs of the flip-flops 58-1 and 58-2 become the signals DSPX and DSPY, respectively, indicating the range of the group window region.

Note, if the display position control of each window is not effected using the relative coordinates, the construction shown in FIG. 5 can be further simplified.

Figure 6:
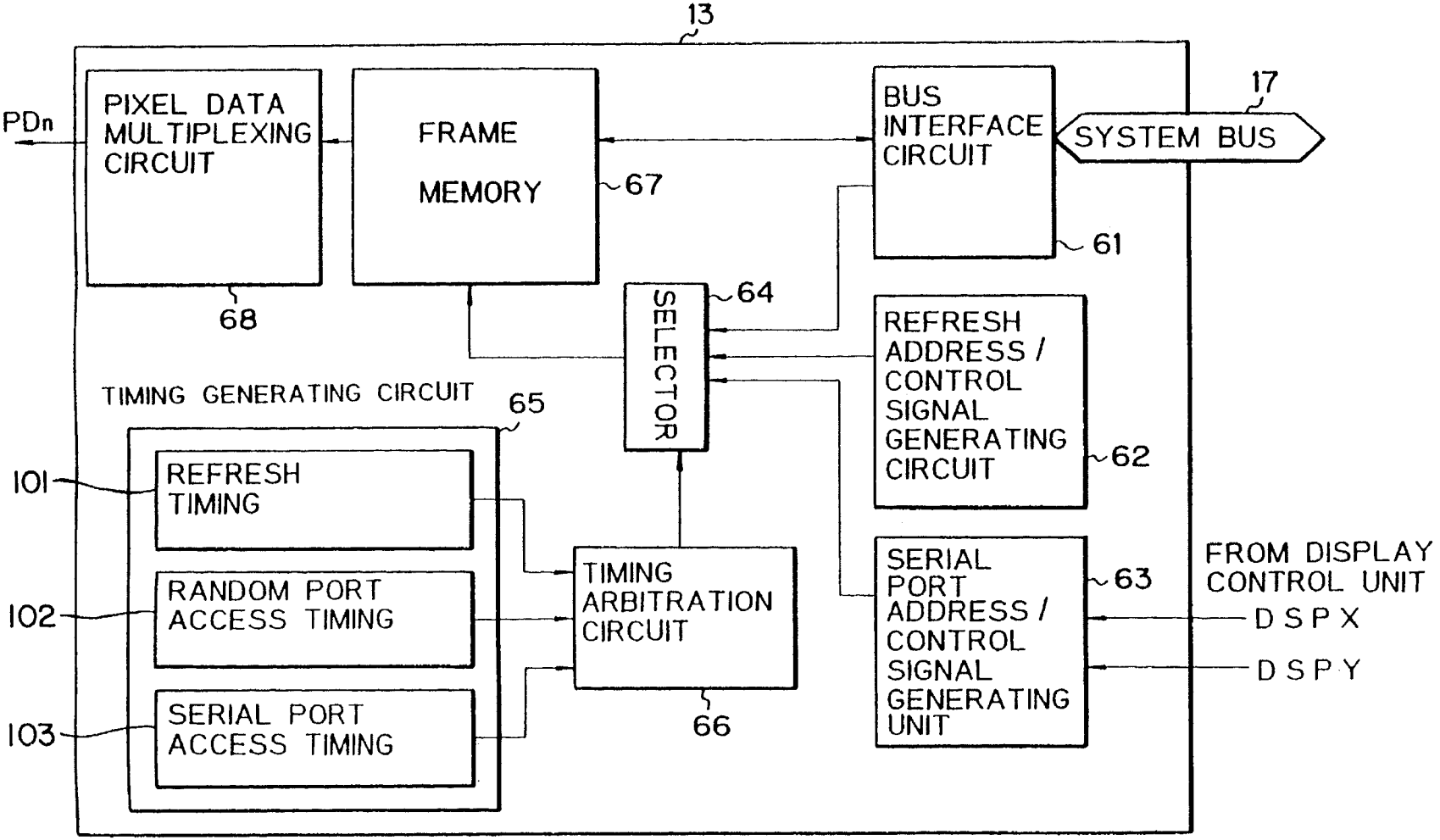
FIG. 6 is a diagram showing the frame memory unit shown in FIG. 4.

The frame memory unit 13 shown in FIG. 4 has a construction as shown in FIG. 6.

In FIG. 6, 61 is a bus interface circuit having an interface with address/data lines and control signal lines in the system bus 17, and a frame memory 67 is used for storing pixel data and is constructed using a dual port dynamic random access memory (RAM) having random ports and serial ports.

A refresh address/control signal generating circuit 62 is used for generating an address at the time of a refreshing of the frame memory 67 and control signals relating to the refreshing address.

A serial port address/control signal generating circuit 63 is a circuit for receiving the signals DSPX and DSPY, from the display control unit 43, indicating the range of the group window region in the X direction and in the Y direction, and for generating control signals, and an address of a serial port which outputs pixel data from the frame memory 67 and control signals.

A timing generating circuit 65 is a circuit for generating refresh timing 101 for the dynamic RAM constituting the frame memory 67, a random port access timing 102 from an external CPU and so forth, and serial port access timing 103. A timing arbitration circuit 66 is a circuit for arbitrating or determining the timing output from the timing generating circuit 65, and for controlling a selector 64.

A pixel data multiplexing circuit 68 is used for multiplexing digital pixel data output from several serial ports in accordance with a pixel clock frequency.

Pixel data to be displayed on the window is written into the frame memory 67 through the system bus 17 and the bus interface circuit 61 by processing from an external processor (CPU) and so forth, and pixel data is read from a serial port of the frame memory 67 by the signal generated from the serial port address/control signal generating circuit 63, and finally, in response to the pixel clock frequency, pixel data $PD_n$ is output from the pixel data multiplexing circuit 68.

An example of the Construction of a Display Interface Unit 16

Figure 7:
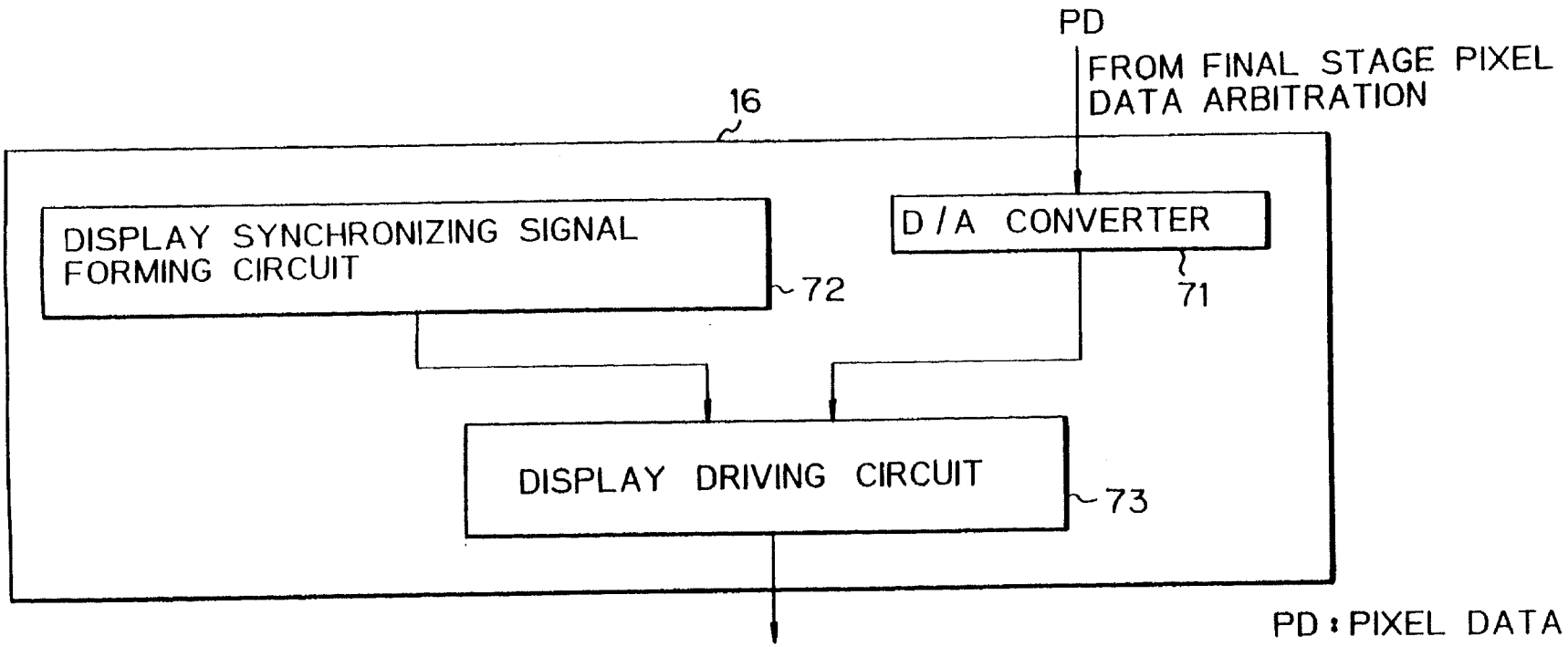
FIG. 7 is a diagram showing the construction of a display interface unit of the present invention.

FIG. 7 shows a block diagram of the display interface unit 16 according to an embodiment of the present invention.

The display interface unit 16 comprises a digital-to-analog (D/A) converter 71, a display synchronization signal generating circuit 72, and a display driving circuit 73.

The D/A converter 71 is used for converting a digital signal of the pixel data PD, which is the output of the final stage pixel data arbitration circuit, into an analog signal. The display synchronization signal generating circuit 72 is used for preparing a horizontal synchronization signal or a vertical synchronization signal synchronized with a raster scan, and the display driving circuit 73 synthesizes the output of the D/A converter 71 and the output of the display synchronization signal preparing circuit 72 to generate a display signal.

An Example of the Construction of the Outline Generating Unit 10: First Embodiment FIG. 8 shows the first embodiment of the outline generating unit 10.

In FIG. 8, a bus interface circuit 81 has an interface with the address/data lines and the control lines in the system bus 17, and the group number storing frame memory 11 is constructed using a dual port dynamic RAM having a random port and a serial port.

A refresh address/control signal generating circuit 82 is used for generating an address of the group number storing frame memory 11 when it is refreshed, and a control signal related to the refreshing address, and a serial port address/control signal generating circuit 83 is used for generating an address and a control signal for a serial port from which a group number corresponding to pixel data is output.

A timing generating circuit 85 is used for generating refresh timing 104 for the dynamic RAM which constructs the group number storing frame memory 11, timing for an access of the random port 105 by an external CPU and so forth, and timing for a serial port access 106.

A timing arbitration circuit 86 is used for arbitrating or determining the output timings from the timing generating circuit 85 to control a selector 84. When the timings are in competition, an arbitration is carried out of the priority order from a serial port access timing, through a refresh timing, to a random port access timing.

A pixel data multiplexing circuit 87 is used for multiplexing, in accordance with the pixel clock frequency, digital data having a group number GN corresponding to respective pixels output from several serial ports.

Group numbers are written into the group number storing frame memory 11 through the system bus 17 and the bus interface circuit 81 by accessing from an external CPU and so forth. A group number is read from the serial port of the group number storing frame memory 11, by a signal generated from the serial port address/control signal generating circuit 83, and a group number GN for each pixel is finally output by the pixel data multiplexing circuit 87 in response to the pixel clock frequency.

Note, when the display overlapping relationship of the windows in a window group is to be changed, the data in the group number storing frame memory 11 is changed. In this embodiment, the frame memory 11 is directly rewritten in accordance with an instruction from the processor. By applying a technique used in an animation display and so forth, however, it is possible to reduce the frame memory capacity and to carry out a high speed control. This technique per se is not directly related to the gist of the present invention, and is not essential for the reduction to practice, and thus a detailed explanation of this technique is omitted here.

As a specific effect in this embodiment, various types of and arbitrary shaped group window regions can be generated, since the writing/updating of the group number into the group number storing frame memory 11 is carried out by software control by a processor.

Another Example of Construction of the Outline Generating Unit 10: Second Embodiment By constructing the outline generating unit 10 as shown in FIG. 9, for example, the group number signals can be generated by hardware instead of generating the group number signals by accessing the group number storing frame memory 11 shown in FIG. 8.

The outline generating unit 10 shown in FIG. 9 includes a display enable region address generating unit 91 for generating display addresses in the horizontal direction X and in the vertical direction Y, to be displayed on the display, and a group window rectangular region generating unit 92 for generating rectangular region signals for the respective group windows GW#0, GW#1, GW#2, . . . , and GW#n by the abovementioned display addresses X and Y and values set by a processor connected through the system bus 17. The outline generating unit 10 also includes special region generating unit 93 for generating special group window region signals such as page turning pattern signals, a display priority sorting switch unit 94 for switching the group window region signals from a higher order of the display priority to a lower order of the display priority, a display priority determining unit 95 for determining a group window region signal having the highest priority among the effective plural group window region signals output from the display priority sorting switching unit 94 to enable the corresponding output signal, and a group number register unit 96 for outputting a group number GN which is set by the processor during the enabling of the signal output from the display priority determining unit 95.

Figure 10A:
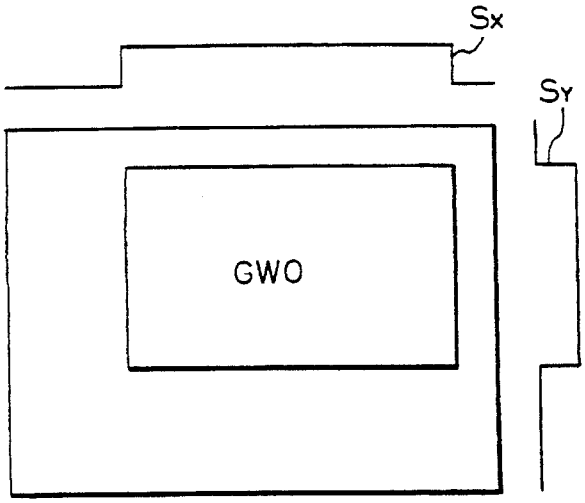
FIGS. 10A to 10D are diagrams explaining signals relating to the outline generating unit shown in FIG. 9.

The group window region signal is a signal indicating the maximum range which can be occupied by the grouped windows in the group of windows. When the region is a rectangular region GW0 as shown in FIG. 10A, the group window region signal is obtained by synthesizing the X direction signal $S_X$ and the Y direction signal $S_Y$ in accordance with the horizontal synchronization signal and the vertical synchronization signal. The X direction signal $S_X$ conforms with the X-direction side of the region GW0, and the Y direction signal $S_Y$ conforms with the Y-direction side of the region GW0.

Figure 10B:
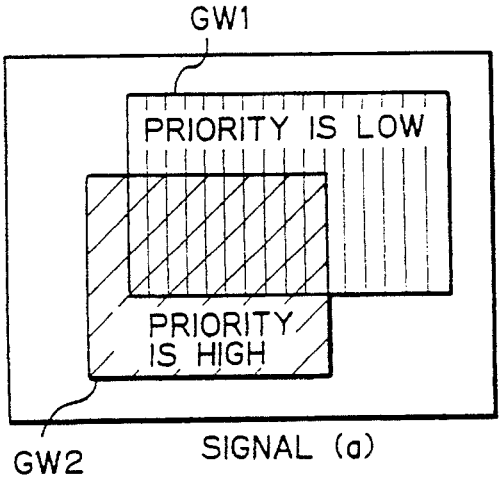
Figure 10C:
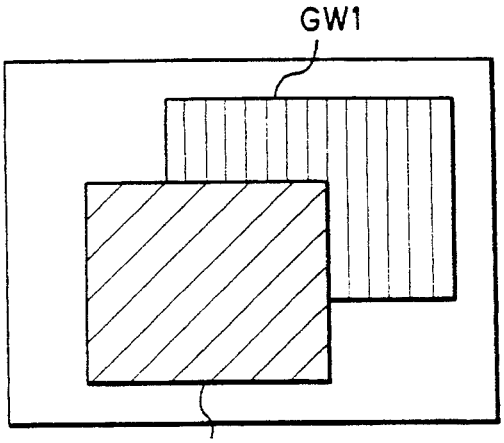

The signals output from the priority sorting switch unit 94 shown in FIG. 9 are, as shown in FIG. 10B for example, the respective group window region signals GW1 and GW2 arranged in the display priority order. When there is an overlap between the group window regions also represented by GW1 and GW2, the display priority determining unit 95 determines, as shown in FIG. 10C, that only the group window region signal having the highest priority is enabled.

Figure 10D:
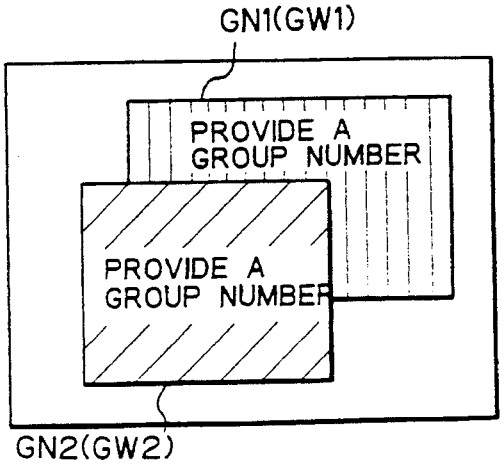

The group number register unit 96 replaces these group window region signals GW1 and GW2 with the group number signals GN1 and GN2, as shown in FIG. 10D, which are the values preset in the group number register 96.

Figure 11:
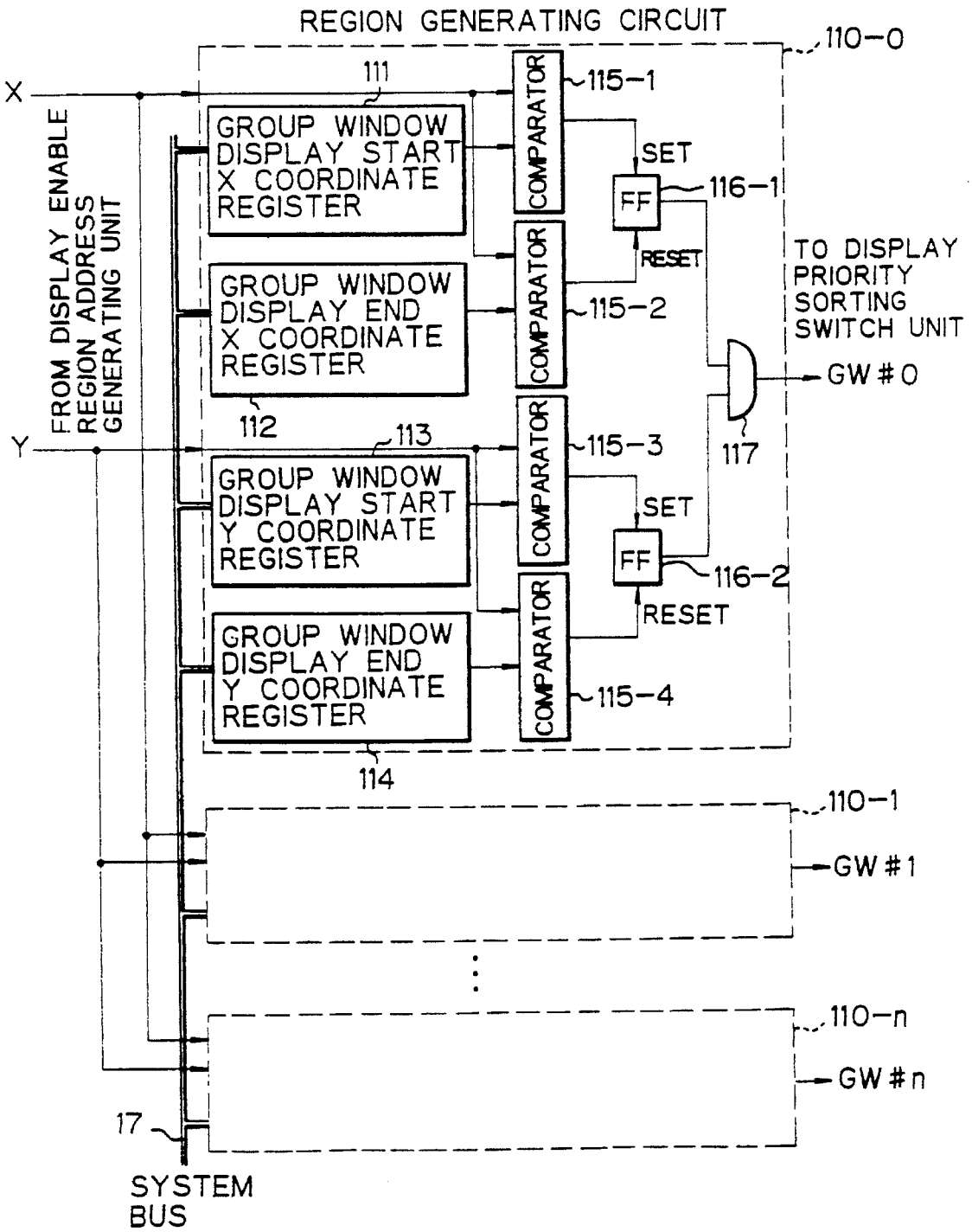
FIG. 11 is a diagram showing an example of the construction of a group window rectangular region generating unit shown in FIG. 9.

FIG. 11 shows an example of the construction of the group window rectangular region generating unit 92 in the outline generating unit 10.

In FIG. 11, the group window rectangular region generating unit 92 comprises region generating circuits 110-0 to 110-n corresponding to the respective group windows. These region generating circuits have the same structure having a group window display start X coordinate register 111, a group window display end X coordinate register 112, a group window display start Y coordinate register 113, and a group window display end Y coordinate register 114. In these registers, a start coordinate of the upper left and the end coordinate of the lower right of the rectangular region are set by a processor through the system bus 17.

A comparator 115-1 compares the X address generated by the display enable region address generating unit 91 shown in FIG. 9 and the value in the group window display start X coordinate register 111, and when they coincide, a flip-flop 116-1 is set. When the X address coincides with the value of the group window display end X coordinate register 112, the flip-flop 116-1 is reset.

With respect to the Y direction also, comparators 115-3 and 115-4 control the set/reset of the flip-flop 116-2, and when both the flip-flops 116-1 and 116-2 are set, the group window region signals GW#i (i=0 to n) are output through an AND gate 117.

The special region generating unit 93 shown in FIG. 9 is used for generating a pattern of a special region other than a rectangular region. The special pattern is, for example, that used in the page turning operation when the group window rectangular region signals GW are used for determining the relative coordinates of the windows. The special region generating unit 93 has a construction as shown, for example, in FIG. 12.

Figure 12:
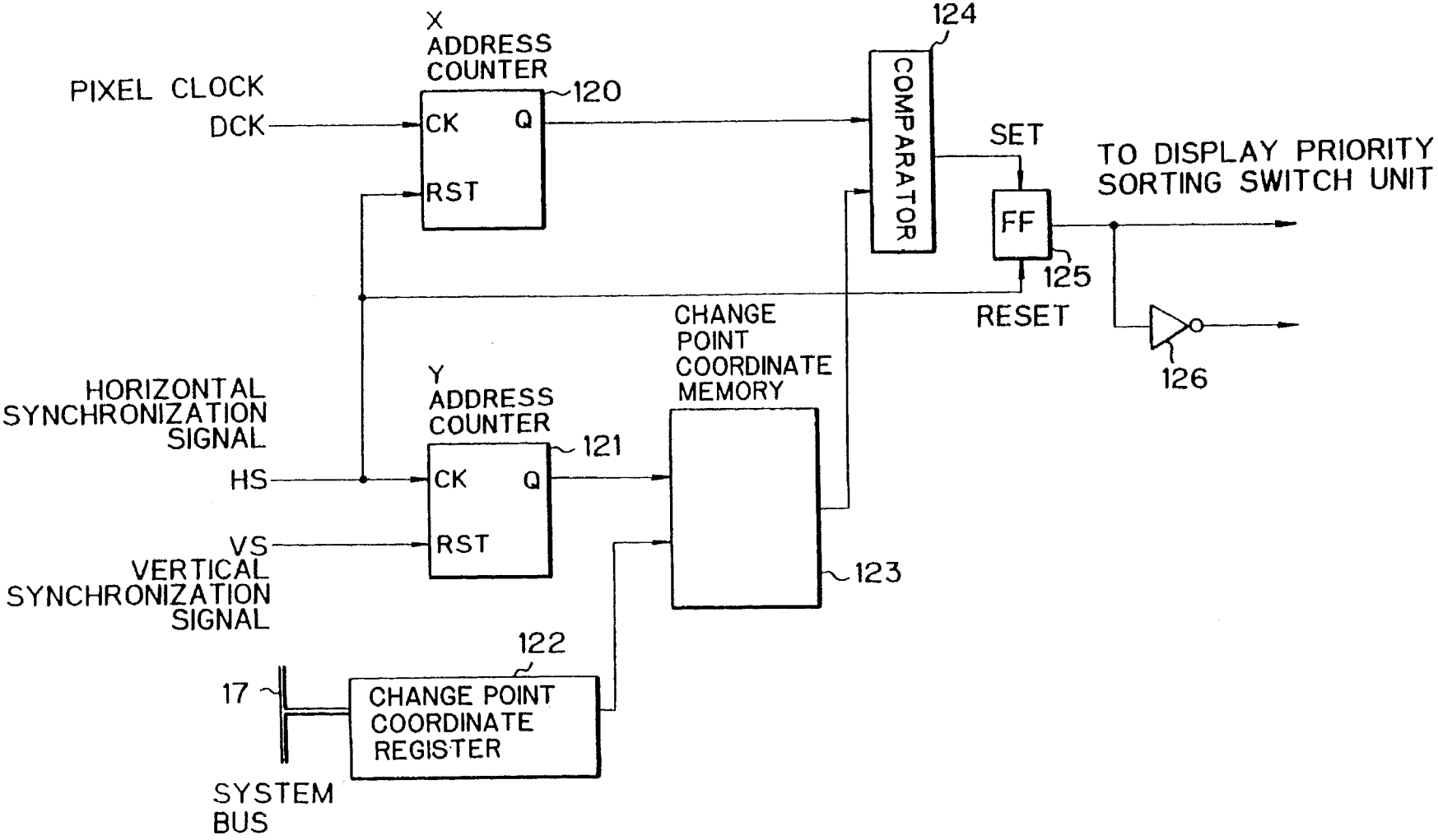
FIG. 12 is a diagram showing an example of the construction of a special region generating unit shown in FIG. 9.

As shown in FIG. 12, there are provided an X address counter 120 for counting pixel clocks DCR for each horizontal synchronization signal HS, and a Y address counter 121 for counting the horizontal synchronization signals HS for each vertical synchronization signal VS, a change point coordinate register for designating a set of the change point coordinates to be selected, and further, a change point coordinate memory 123 in which a set of coordinates indicating the boundaries of the group window region (referred to as change point coordinates) for each line are stored.

The value read from the change point coordinate memory 123 and the output of the X address counter 120 are compared by a comparator 124, and when they coincide, a flip-flop 125 is set. The output of the flip-flop (FF) 125 is sent, as is or through an inverter 126 in accordance with a selection by a processor, to the display priority sorting switch unit 94, and is used as a signal of a group window region having a special shape.

Figure 13:
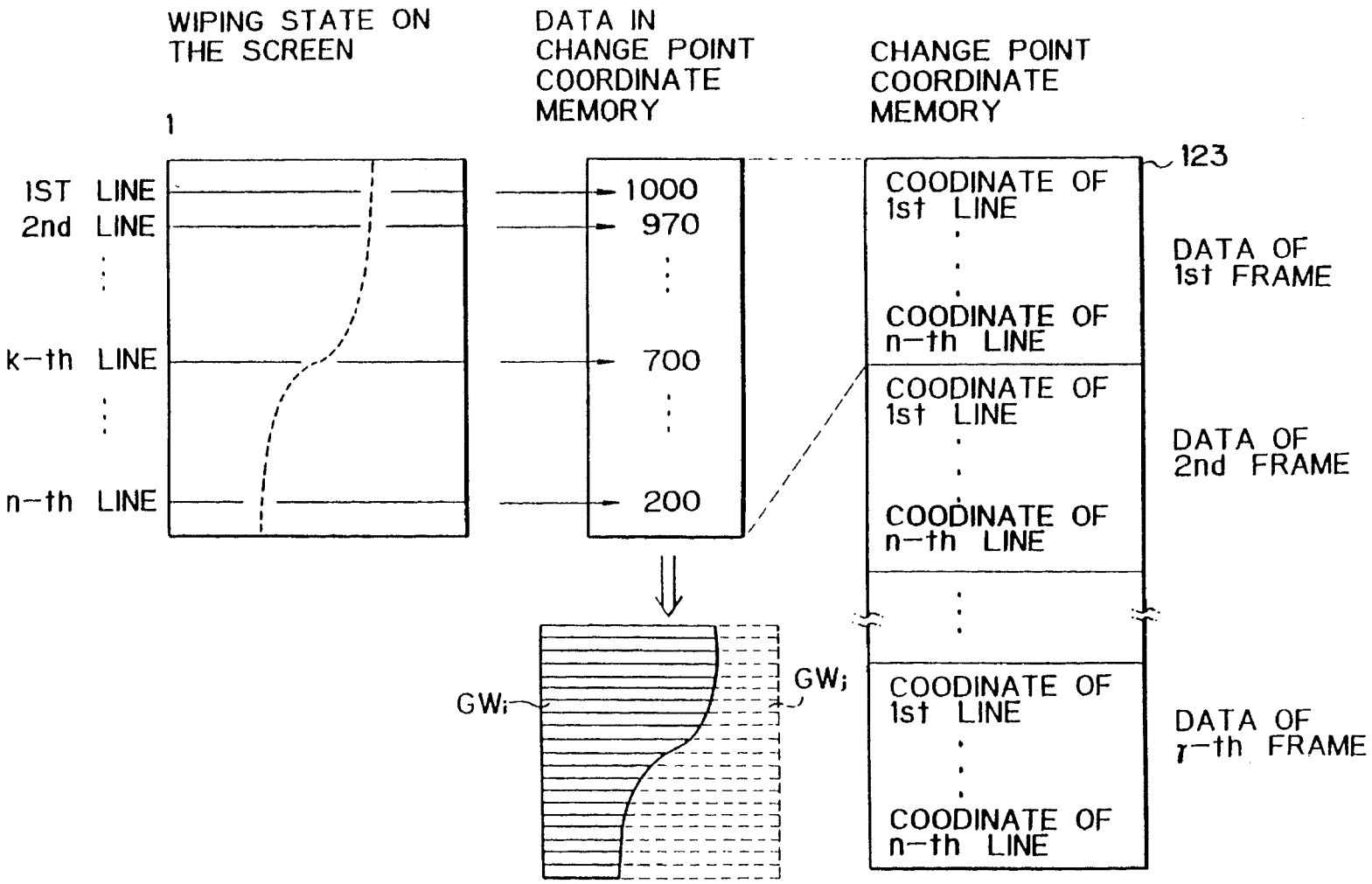
FIG. 13 is a diagram explaining the generation of the special region generated by the special region generating unit shown in FIG. 12.

Practically, the special region generating unit 93 has a construction as shown in FIG. 13. It is assumed that the size of the display screen is m dots×n lines. The change point coordinate memory 123 stores several sets of change point coordinates which each include X coordinate values from the first line to the n-th line. In the example shown in FIG. 13, sets of the change point coordinates from first frame to Γ-th frame can be stored.

For example, when the data in the first frame is selected, and when the data is 1000 for the first line, 970 for the second line, . . . , and 200 for the n-th line, then the group window region signals GW are generated in such a way that, in the first line, the group window region starts or ends when the X address becomes 1000, and in the second line, the group window region starts or ends when the X address becomes 970. This is the same for the other lines.

As a result, a region signal GWi or GWj is generated as shown in FIG. 13.

In this embodiment, since the change of the region occupied by each group number can be controlled by hardware, a specific effect of a high speed change is obtained.

Still Another Example of the Construction of the Outline Generating Unit 10: Third Embodiment When the control of the display position of each window in one group window is effected by a relative coordinate with respect to the region occupied by the group window, the pixel data arbitration unit 14 and each frame memory control unit 12-i shown in FIG. 1 must know the position of the region occupied by the group window.

To this end, in the third embodiment, as shown in FIG. 14, the output signals of the group window rectangular region generating unit 92, i.e., the group window region signals GW#0, GW#1, GW#2, . . . , and GW#n, are output to the pixel data arbitration unit 14 in the multiwindow display control apparatus shown in FIG. 1, and a corresponding one of these signals GW#0, GW#1, GW#2, . . . , and GW#n is sent to each frame memory control unit 12-i through the pixel data arbitration unit 14. The circuit construction other than this output function is the same as that of the second embodiment shown in FIG. 9.

The third embodiment has an advantage in that, when the display position of the group window is to be changed, each frame memory control unit 12-i can manage each window by the relative coordinates with respect to the group window region.

An Example of the Construction of the Pixel Data Arbitration Unit 14: Fourth Embodiment FIG. 15 shows an example of the pixel data arbitration circuit 15-n in the pixel data arbitration unit 14 having the daisy chain structure as shown in FIG. 3A.

The n-th (n=1, 2, . . . ) pixel data arbitration circuit 15-n includes as fundamental construction elements, a comparator 151 for detecting a coincidence between the group number $GN_{n-1}$ from the previous stage pixel data arbitration circuit 15-(n-1) and the group number $GN_N$ from the n-th stage frame memory control unit 12-n, and a comparator 152 for detecting whether the priority number from the previous stage pixel data arbitration circuit 15-(n-1) is smaller than the priority number $GN_N$ from the n-th stage frame memory control unit 12-n. In addition, pixel data arbitration circuit 15-n provides an AND gate 153 having inputs for receiving the outputs of the comparators 151 and 152 and the display enable indication signal $DE_n$ from the n-th stage frame memory control unit 12-n, to output a control signal S. Further, a selector 154 is provided for selecting an A group of the signals from the previous stage pixel data arbitration circuit 15-(n-1) when the control signal S is "L" and for selecting a B group of signals including the group number signal $GN_{n-1}$ from the previous stage pixel data arbitration circuit 15-(n-i), the priority number signal $PN_n$ from the n-th stage frame memory control unit 12-n, and the pixel data $PD_n$ from the n-th stage frame memory control unit 12-n when the control signal S is "H".

The signals of a group number $GN_{n-1}$ a priority number $PN_{n-1}$ and pixel data $PD_{n-1}$ output from the (n–1)-th pixel data arbitration circuit become inputs of the n-th pixel data arbitration circuit 15-n. Note, that if the pixel data arbitration circuit 15-n had the bus connection of FIG. 3B, the only difference would be that group number $GN_{n-1}$ would be output from outline generating unit 10 instead of pixel data arbitration circuit 15-(n-i).

Also, the signals of a group number $GN_n$, a priority number $PN_n$, pixel data $PD_n$, and a display enable indication signal $DE_n$ indicating whether the pixel data $PD_n$ is effective or invalid and which are output from the n-th stage frame memory control unit, become inputs of the n-th pixel data arbitration circuit 15-n.

The comparator 151 determines whether or not the group numbers $GN_{n-1}$ and $GN_n$ or are the same, and the comparator 152 determines whether or not the priority number $PN_n$ is larger than the priority number $PN_{n-1}$ which has been sent from the previous stage. When these two conditions and a condition of the display enable indication signal $DE_n$ are satisfied, the output of the AND gate 153 becomes "H", and the 2-1 selector 154 selects the signal of the B group and outputs it to the (n+1)-th stage pixel data arbitration circuit. As a result, although the group number GN is not changed, the priority number PN and the pixel data PD are changed from those of the (n–1)-th stage to $PN_n$ and $PD_n$ of the n-th stage.

On the other hand, when the AND of the abovementioned three conditions is not satisfied, all signals from the (n–1)-th stage of the A group are output to the (n+1)-th stage pixel data arbitration circuit of the next stage, without change.

Next, the principle of the total operation of the multiwindow display control apparatus according to this fourth embodiment of the present invention is described according to FIG. 16.

In FIG. 16, $PD_1$ to $PD_6$ are pixel data, $GN_1$ to $GN_6$ are group numbers, $PN_1$ to $PN_6$ are priority numbers, GNR is a group number register, PNR is a priority number register, FM is a frame memory unit 13-i for storing pixel data, and DE is a display enable signal indicating validity of the display, i.e., when "1", the display is valid, and when "0", the display is invalid. Note, in FIG. 16, each of the pixel data $PD_1$ to $PD_6$ includes four pixels, and the respective pixel data flow serially in synchronization with the pixel clock. To enhance the processing speed, it is possible to process several pixels as one with parallel data during the process up to the final output.

The outline generating unit 10 generates pixel data $PD_1$ of the background, group numbers $GN_1$ of "2", "1", "3", and "1" for the respective pixels, and lowest priority numbers $PN_1$ which are all "0".

At a position (1), the pixel data arbitration circuit 15-1 receives the signals $PD_1$, $GN_1$, and $PN_1$ pixel by pixel, finds a coincidence between the group number $GN_1$ and a value "1" stored in the group number register GNR, and compares the priority number $PN_1$ corresponding to the pixel data having the group number $GN_1$ equal to the value in the group number register GNR. In this example, the group numbers of the second and fourth pixels in $GN_1$ are the same as the value "1" in the group number register GNR. With respect to the second and fourth pixels, since the priority number register PNR in the frame memory control unit 12-1 stores "1", which is larger than the "0" in the priority numbers $PN_1$, and the display enable indication DE of the corresponding pixel is valid (DE="1") the corresponding pixel data and the priority numbers of the $PN_1$ output from the outline generating unit 10 are replaced by the pixel data stored in the frame memory FM and the priority number of "1" in the priority number register PNR in the frame memory control unit 12-1. The replaced pixel data and the priority numbers are then output as pixel data $PD_2$ and a priority number $PN_2$, from the pixel data arbitration circuit 15-1.

At a position (2), the group number of the first pixel coincides with the value "2" in the group number register GNR, and therefore, by a similar comparison, the pixel data and a priority number of the first pixel output from the pixel data arbitration circuit 15-1 are replaced by the pixel data and the priority number in the frame memory control unit 12-2. Thus, the pixel data arbitration circuit 15-2 outputs the pixel data $PD_3$ and the priority numbers $PN_3$ as illustrated.

A similar operation is carried out at a position (3).

At a position (4), since the group number identical to "4" stored in the group number register GNR of the frame memory control unit 12-4 is not included in the group numbers $GN_4$ output from the outline generating unit 10, $PD_4$ and $PN_4$ are output as $PD_5$ and $PN_5$, without replacement.

At a position (5), the pixels which satisfy the condition that the group numbers are the same as each other and the priority in the PNR in the frame memory control unit 12-5 is larger than the priority number output from the pixel data arbitration circuit 15-4, are the second pixel and the fourth pixel. The display enable indication DE corresponding to the fourth pixel, however, is "0", i.e., invalid, and thus only the second pixel is the subject to be replaced.

As described above, at each frame memory control unit, pixel data and priority numbers are replaced by the corresponding one of the pixel data arbitration circuit 15-1 to 15-5, and finally, pixel data having a group number which coincides with the group number generated from the outline generating unit 10, having the largest priority number, and having a display enable indication which indicates a validity of the display, are output and displayed through the display interface unit 16.

A specific effect of this fourth embodiment employing the daisy chain structure is the enabling of a high transfer speed, and a reduction in the number of signal lines by multiplexing, since the transfer distance of signals and the synchronization among the signals are limited to between adjacent boards of the pixel data arbitration circuits. That is, because of the short distance between adjacent boards, and because each board independently performs synchronization timing of a receiving signal to transmit it to the next board, the requirement for system design relating to the timing is very loose or reduced, so that the frequency of the transmitted signal can be made extremely high. Therefore, the signals can be transmitted by multiplexing, resulting in the decrease in the number of signal lines.

An Example of the Construction of the Pixel Data Arbitration Unit 14: Fifth Embodiment FIG. 17A shows a second example of the pixel data arbitration circuit in the pixel data arbitration unit 14 having a daisy chain structure.

In FIG. 17A, reference numeral 177 is a pixel data calculating unit having an A terminal and a B terminal as inputs. When the A terminal is at the "L" level and the B terminal is at the "H" level, the pixel data calculating unit 177 selects the pixel data $PD_n$ output from the n-th stage frame memory control unit 12-n to be output as the pixel data $PD_n$, and when both the A terminal and the B terminal are at the "L" level, the calculating unit 177 selects the pixel data $PD_{n-1}$ output from the previous stage pixel data arbitration circuit 15-(n-1) to be output as the pixel data $PD_n$. When the A terminal is at the "H" level and the B terminal is at the "L" level, the calculating unit 177 becomes a circuit having a raster operation function such as AND, OR, inversion, etc. between the two input data. The kinds of the logical calculation in the raster operation can be instructed from, for example, an external processor not shown in the figure.

Other than the control of the signals by the pixel data calculating unit 177 of the group number $GN_{n-1}$ the priority number $PN_{n-1}$ and the pixel data $PD_{n-1}$ output from the (n–1)-th stage pixel data arbitration circuit 15-(n-I), and the pixel data $PD_n$ sent from the n-th stage frame memory control unit 12-n, the pixel data arbitration circuit 15-n shown in FIG. 17A is the same as that of the fourth embodiment explained with reference to FIG. 15. Therefore, an explanation thereof is omitted, and only the new portions relating to the pixel data $PD_{n-1}$ and $PD_n$ are explained.

When the conditions, i.e., the group numbers $GN_{n-1}$ and $GN_n$ are equal in comparator 171, the priority number $PN_n$ is larger than the $PN_{n-1}$ in comparator 172 and the display enable indication $DE_n$ is valid, are satisfied, the A terminal of the pixel data calculating unit 177 becomes "L" and the B terminal becomes "H", through AND gates 174 and 175. Then, the pixel data calculating unit 177 selects the signal $PD_n$ from the n-th stage frame memory control unit 12-n and outputs it to the (n+1) system, and as a result, the pixel data is replaced from the $PD_{n-1}$ output from the (n–1)-th stage pixel data arbitration circuit 15-(n-1) to the $PD_n$ output from the n-th stage frame memory control unit 12-n.

On the other hand, when the conditions, i.e., the group numbers $GN_{n-1}$ and $GN_n$ are equal in comparator 171, the priority number $PN_n$ is equal to the $PN_{n-1}$ in comparator 173, and the display enable indication $DE_n$ is valid, are satisfied, the A terminal of the pixel data calculating unit 177 becomes "H" and the B terminal becomes "L", through AND gates 174 and 175. Then, the pixel data calculating unit 177 performs a predetermined calculation among the pixel data $PD_{n-1}$ of the (n–1)-th stage and the pixel data $PD_n$ of the n-th stage, and outputs the calculated result to the (n+1)-th stage.

When both the A terminal "L" and the B terminal are "L", all signals from the (n–1)-th stage are output without change to the (n+1)-th stage pixel data arbitration circuit.

FIG. 17B shows an example of the pixel data calculating unit 177 in the circuit shown in FIG. 17A. In FIG. 17B, the pixel data calculating unit 177 includes a distributor 21, a fade-in/fade-out calculating circuit 22, a raster operation calculating circuit 23, and a switch 27. The raster operation calculating circuit 23 includes, for example, sixteen logic circuits OR, AND, NAND, etc. The fade-in/fade-out calculating circuit 22 includes two multipliers 25 and 24, and an adder 26. The distributor 21 receives the priority numbers $PD_{n-1}$ and $PD_n$ and distributes them to the fade-in/fade-out calculating circuit 22 and to each of the logic circuits in the raster operation calculating circuit 23. In the multipliers 25 and 24, multiplying coefficients c1 and c2 are set by a processor through the system bus 17. The multiplying coefficients c1 and c2 are between 0 and 1. The switch 27 selects, under the control of the processor through the system bus 17, one of the outputs from the system bus 17, one of the outputs from the fade-in/fade-out circuit 22 and the outputs from logic circuits in the raster operation calculating circuit 23.

By continuously changing the coefficients c1 and c2, the priority number $PD_n$ output from the fade-in/fade-out calculating circuit 22 is gradually changed. Thus, when the switch 27 selects the output from the fade-in/fade-out calculating circuit 26, the screen transition of fade in or fade out can be realized.

The sixteen raster operations in raster operation calculating circuit 23 are as follows.

| | |
|---|---|
| out = 0 | out = (NOT $PD_{n-1}$) AND NOT $PD_n$ |
| out = $PD_{n-1}$ AND $PD_n$ | out = (NOT $PD_{n-1}$) XOR NOT $PD_n$ |
| out = $PD_{n-1}$ AND NOT $PD_n$ | out = NOT $PD_n$ |
| out = $PD_{n-1}$ | out = $PD_{n-1}$ OR NOT $PD_n$ |
| out = (NOT $PD_{n-1}$) AND $PD_n$ | out = NOT $PD_{n-1}$ |
| out = $PD_n$ | out = (NOT $PD_{n-1}$) OR $PD_n$ |
| out = $PD_{n-1}$ XOR $PD_n$ | out = (NOT $PD_{n-1}$) OR NOT $PD_n$ |
| out = $PD_{n-1}$ OR $PD_n$ | out = 1 |

This fifth embodiment (5) provides a specific effect in that a screen transition such as fade in, fade out and so forth can be easily realized.

An Example of the Construction of the Pixel Data Arbitration Unit 14: Sixth Embodiment FIG. 18 shows an example of the pixel data arbitration circuit 15-n having a daisy chain structure in the pixel data arbitration unit 14, in which a pixel data forcible changing mechanism is provided.

In this sixth embodiment, a forcible change instructing register (not shown in the figure) for instructing a forcible change of all of the group number GN, the priority number PN, and the pixel data PD, is newly added to the frame memory control unit 12 shown in FIG. 4.

When the frame memory control unit 12 or the pixel data arbitration circuit 15-i is used for displaying a cursor indication or a pop-up menu, for example, preferably the cursor or the pop-up menu can be forcibly displayed at a necessary position without rewriting the group number generated by the outline generating unit 10. To this end, in this embodiment, there is provided a means for enabling a forcible change of the group number, the priority number, and the pixel data.

The pixel data arbitration circuit 15-n shown in FIG. 18 has, as basic construction elements, a comparator 181 for detecting a coincidence, a comparator 182 for comparing large and small values, AND gates 183 and 184, OR gate 185, and two selectors 186 and 187 each for selecting the A system when a control line S is "L" and for selecting the B system when it is "H".

When the forcible changing indication register is set to "0", i.e., when the change request signal $CG_n$ is "L" and inactive, the operation is almost the same as that of the fourth embodiment described with reference to FIG. 15.

The operation of the pixel data arbitration circuit 15-n shown in FIG. 18, when the change request signal $CG_n$ is at the "L" level and inactive, is as follows. The signals of the group number $GN_{n-1}$ the priority number $PN_{n-1}$ and the pixel data $PD_{n-1}$ output from the (n−1)-th stage pixel data arbitration circuit 15-(n-1) become the inputs of the n-th stage pixel data arbitration circuit 15-n. Also, the signals of the group number $GN_n$ the priority number $PN_n$, the pixel data $PD_n$, the group number changing request $CG_n$, and the display enable $DE_n$ signal designating validity/invalidity of the pixel data $PD_n$ become the inputs of the n-th stage pixel data arbitration circuit 15-n.

The group number $GN_{n-1}$ and the group number $GN_n$ are compared by the comparator 181 to detect coincidence, and the comparator 182 carries out a comparison to determine whether the priority number $PN_n$ is larger than the priority number $PN_{n-1}$ . from the previous stage. When the above-mentioned two conditions and the condition that the display enable indication $DE_n$ are satisfied, the output of the AND gate 183 becomes "H" and the selector 186 selects the signals of the priority number $PN_n$ and the pixel data $PD_n$ of the B system and outputs them to the (n+1)-th stage. As a result, the signals $PN_{n-1}$ and the $PD_{n-1}$ from the (n−1)-th stage are replaced by the $PN_n$ and the $PD_n$ of the n-th stage.

On the other hand, when the AND of the abovementioned three conditions cannot be taken or satisfied, all signals from the (n−1)-th stage are output to the next (n+1)-th stage pixel data arbitration circuit, without change.

When the signal of the change request $CG_n$ is "H" and active, the control signal line S of the two selectors 186 and 187 are forcibly set to "H" while the display enable indication $DE_n$ is "H", so that the group number $GN_n$ the priority number $PN_n$, and the pixel data $PD_n$ of the B system are selected to be output to the (n+1)-th stage. At this time, by storing in the group number register in the frame memory control unit a group number which is not used in the outline generating unit, it is ensured that the pixel data output from the n-th stage frame memory is displayed.

In this sixth embodiment, by providing a means for forcibly replacing a group number in the pixel data arbitration circuit 15-n, a specific effect is obtained in that a cursor display or a display of a pop-up menu can be carried out at a high speed.

Another Example of the Pixel Data Arbitration Circuit 15-n: Seventh Embodiment FIG. 19 shows another example in this seventh embodiment of the pixel data arbitration circuit 15-n having a daisy chain structure in the pixel data arbitration unit 14; the example of the circuit being used in combination with the third embodiment of the outline generating unit 10 described with reference to FIG. 14.

The pixel data arbitration circuit 15-n shown in FIG. 19 has a construction in which a selector 191 for selecting a group window region signal $GW_n$ is added to the pixel data arbitration circuit 15-n shown in FIG. 15.

In response to the group number signal $GN_n$ output from the group number register in the n-th stage frame memory control unit 12-n, the selector 191 selects a corresponding group window region signal $GW_n$ from the group window region signals $GW_{n-1}$ in a k-line bus output from the outline generating unit.

The n-th stage frame memory control unit 12-n generates display coordinates of the group window, from the selected group window region signal $GW_n$, and outputs pixel data to the position at which the pixel data is to be displayed. The position is indicated by relative coordinates with reference to the display coordinates.

According to this seventh embodiment, since the display position of the individual window can be managed by relative coordinates with respect to the display coordinates of the group window, it is not necessary to change the coordinate of the display position of the individual window even when the position of the group window is changed. Therefore, an effect is obtained such that the change of the display of a group window is made easy.

A Still Further Example of the Construction of the Pixel Data Arbitration Unit 15-n: Eighth Embodiment FIG. 20 shows an another example in this eighth embodiment of the pixel data arbitration circuit; the example of the circuit being used in combination with the third embodiment of the outline generating unit 10 described with reference to FIG. 14.

The pixel data arbitration circuit 15-n shown in FIG. 20 has a construction in which, a selector 201 for selecting a group window region signal $GW_n$ is added to the pixel data arbitration circuit 15-n shown in FIG. 17A.

In response to the output $GN_n$ from the group number register in the n-th stage frame memory control unit, the selector 201 selects a corresponding group window region signal $GW_n$ from the group window region signals $GW_{n-1}$ in the k-line bus, output from the outline generating unit.

The n-th stage frame memory control unit generates display coordinates of the group window from the selected group window region signal $GW_n$, and outputs pixel data to the position at which the pixel data is to be displayed. The position is indicated by relative coordinates with reference to the display coordinates.

According to this eighth embodiment, in addition to the effect of the fifth embodiment, similar to the seventh embodiment, an effect is obtained such that the change of the display of the group window is made easy.

A Still Further Example of the Construction of the Pixel Data Arbitration Unit 15-n: Ninth Embodiment FIG. 21 shows a still further in this ninth embodiment of the pixel data arbitration circuit 15-n, the example of the circuit being used in combination with the third embodiment of the outline generating unit 10 described with reference to FIG. 14.

The pixel data arbitration circuit 15-n shown in FIG. 21 has a construction in which a selector 211 for selecting a group window region signal $GW_n$ is added to the pixel data arbitration circuit 15-n shown in FIG. 18.

In response to the output $GN_n$ from the group number register in the n-th stage frame memory control unit, the selector 211 selects a corresponding group window region signal $GW_n$ from the group window region signal $GW_{n-1}$ output from the outline generating unit.

The n-th stage frame memory control unit 12-n generates display coordinates of the group window from the selected group window region signal $GW_n$, and outputs pixel data to the position at which the pixel data is to be displayed. This position is indicated by relative coordinates with reference to the display coordinates.

According to this embodiment, in addition to the effect of the sixth embodiment, similar to that of the seventh embodiment, an effect is obtained such that the change of the display of the group window is made easy.

A Still Further Example of the Construction of the Pixel Data Arbitration Unit 15-n: Tenth Embodiment FIG. 22A shows a still further example in this tenth embodiment of the pixel data arbitration circuit 15-n having a bus structure in the pixel data arbitration unit 14.

The pixel data arbitration unit 15-n in this tenth embodiment has, as basic construction elements, two comparators 221 and 222 for detecting coincidences, an inverter 223, an NAND gate 224, and two three-state buffers 225 and 226.

The signal lines of the group number GN, the priority number PN, and the pixel data PD constitute a bus structure, and all are connected to the pixel data arbitration circuit 15-n. The group number GN generated by the outline generating unit 10 is sent through the signal line of the group number GN.

The connection between the priority number PN and each of the pixel data arbitration circuits 15-i and 15-j is as shown in FIG. 22B. For example, when three lines are provided as the signal lines of the priority number PN, the priority is lowest when all are "H", and the priority becomes higher in accordance with an increase in the number of "L" level lines.

For example, with respect to the three lines of the priority number PN, when the pixel data arbitration circuit 15-i outputs "LHH" to the three lines of the priority number PN, and when the pixel data arbitration circuit 15-j outputs "LLH" to the three lines of the priority number PN, the signal line level becomes "LLH" so that the output of the pixel data arbitration circuit 15-j, which has the highest priority, is enabled.

The operation of the pixel data arbitration circuit 15-i shown in FIG. 22A is as follows.

In the n-th stage pixel data arbitration circuit 15-n, the comparator 221 compares the group number GN generated by the outline generating unit 10 and the group number $GN_n$ output from the n-th stage frame memory control unit 12-n.

When a coincidence is found an output control gate *OE of the three-state buffer 225 becomes active and the priority number $PN_n$ output from the n-th stage frame memory control unit 12-n is output through the three-state buffer 225 to the signal line of the priority number PN in the bus. Simultaneously, the priority number PN is input to one of the inputs of the comparator 222, where it is determined whether PN is smaller than the priority number $PN_n$ output by the n-th stage frame memory control unit 12-n. If the priority of the signal line of the priority number PN is higher or larger than the priority number $PN_n$ output from the n-th stage frame memory control unit 12-n, they do not coincide, and if not, they do coincide.

When the priority number in the bus coincides with the priority number from the frame memory control unit, and when the display enable indication $DE_n$ represents that the display is valid, the output control gate *OE of the three-state buffer 226 is made active so that the pixel data $PD_n$ is output to the signal line of the pixel data PD.

In this bus structure system, similar to the fifth embodiment, it is possible to provide a means for calculating pixel data under a specific condition, to thus easily realize a screen transition such as a fade in or fade out. It is also possible for a cursor display and so forth to provide, similar to the sixth embodiment, a means for forcibly replacing the group number.

In the foregoing embodiments, the descriptions were made in which each frame memory control unit has a responsibility to one window, but according to software control of the known art, it is possible to realize a plurality of windows of the frame memory in each frame memory control unit.

From the foregoing description, it will be apparent that, according to the present invention, the display priority order among groups of windows is managed by only the outline generating unit; the overlapping display priority in the same group of windows is managed by each frame memory control unit; and the pixel data arbitration unit only compares parameters from the outline generating unit and each frame memory control unit. Thus the functions for synthesizing picture data are treated by separate circuits, and therefore, with respect to display controls associated with a plurality of windows, the display control among groups of windows and the display control within a group of windows can be effected separately, and thus the control becomes very simple.

We claim:

1. A multiwindow display control apparatus for controlling a display of multiwindows having a plurality of groups of windows each of said plurality of groups of windows having a plurality of windows, comprising:

a plurality of frame memory control means for storing pixel data corresponding to each of said plurality of windows to be displayed, a first group number identifying said plurality of windows located in the each of said plurality of groups of windows, and a priority number identifying a display priority for the each of said plurality of windows located in the each of said plurality of groups of windows, said frame memory control means comprises corresponding frame memory control means;

outline generating means for generating a second group number identifying a desired group of windows to be displayed;

pixel data arbitration means including a plurality of pixel data arbitration circuits connected to each other in a daisy chain structure, operatively connected to said corresponding frame memory control means and to said outline generating means, for determining a determined group of windows having a coincidence when said first group number coincides with said second group number, and for determining a determined window to be displayed having said priority number assigned the highest priority in the determined group of windows; each of said plurality of pixel data arbitration circuits includes:

a previous stage pixel data arbitration circuit connected to said outline generating means storing a previous priority number and previous pixel data;

a next stage pixel data arbitration circuit connected to said outline generating means;

first comparing means for detecting the coincidence between said second group number generated from said outline generating means and said first group number stored in the corresponding frame memory control means;

second comparing means for detecting whether the priority number stored in the corresponding frame memory control means is larger than the previous priority number sent from the previous stage pixel data arbitration circuit; and selecting means for outputting, when said first comparing means detects the coincidence and said second comparing means detects that the priority number stored in the corresponding frame memory control means is larger than the previous priority number sent from the previous stage pixel data arbitration circuit, the priority number and the pixel data stored in the corresponding frame memory control means, and said selecting means for outputting, when one of said first comparing means does not detect the coincidence and said second comparing means detects that the priority number stored in the corresponding frame memory control means is smaller than the previous priority number sent from the previous stage pixel data arbitration circuit, the previous priority number and the previous pixel data sent from the previous stage pixel data arbitration circuit, and said second group number generating from said outline generating means being sent to the next stage pixel data arbitration circuit; and display means, operatively connected to said pixel data arbitration means, for displaying determined pixel data corresponding to the determined window.

2. A multiwindow display control apparatus as claimed in claim 1, wherein each of said frame memory control means stores a display enable signal indicating whether each pixel of the pixel data is to be displayed, and said selecting means selects said priority number and the pixel data stored in the corresponding frame memory control means to be output to the next stage pixel data arbitration circuit when said display enable signal indicates than the each pixel is to be displayed.

3. A multiwindow display control apparatus, for controlling a display of multiwindows having a plurality of groups of windows each of said plurality of groups of windows having a plurality of windows, comprising:

a plurality of frame memory control means for storing pixel data corresponding to each of said plurality of windows to be displayed, a first group number identifying said plurality of windows located in the each of said plurality of groups of windows, and a priority number identifying a display priority for the each of said plurality of windows located in the each of said plurality of groups of windows, said frame memory control means comprises corresponding frame memory control means, outline generating means for generating a second group number identifying a desired group of windows to be displayed;

pixel data arbitration means including a plurality of pixel data arbitration circuits connected to each other in a daisy chain structure, operatively connected to said corresponding frame memory control means and to said outline generating means, for determining a determined group of windows having a coincidence when said first group number coincides with said second group number, and for determining a determined window to be displayed having said priority number assigned the highest priority in the determined group of windows; each of said pixel data arbitration circuits includes:

a previous stage pixel data arbitration circuit connected to said outline generating means storing a previous priority number and previous pixel data;

a next stage pixel data arbitration circuit connected to said outline generating means;

first comparing means for detecting the coincidence between second group number generated from said outline generating means and said first group number stored in the corresponding frame memory control means;

second comparing means for detecting whether the priority number stored in the corresponding frame memory control means is larger than the previous priority number sent from the previous stage pixel data arbitration circuit;

selecting means for outputting, when said first comparing means detects the coincidence and said second comparing means detects that the priority number stored in the corresponding frame memory control means is larger than the previous priority number sent from the previous stage pixel data arbitration circuit, the priority number in the corresponding frame memory control means, and said selecting means for outputting, when one of said first comparing means does not detect the coincidence and said second comparing means detects that the priority number stored in the corresponding frame memory control means is smaller than the previous priority number sent from the previous stage pixel data arbitration circuit, the previous priority number sent from the previous stage pixel data arbitration circuit;

third comparing means for detecting a second coincidence between the previous priority number sent from the previous stage pixel data arbitration circuit and the priority number stored in the corresponding frame memory control means; and pixel data calculating means for outputting, when said first comparing means detects the coincidence and said second comparing means detects the priority number stored in the corresponding frame memory control means is larger than the previous priority number sent from the previous stage pixel data arbitration circuit, the pixel data stored in the corresponding frame memory control means, said pixel data calculating means for outputting, when one of said first comparing means does not detect the coincidence and said second comparing means detects that the priority number stored in the corresponding frame memory control means is smaller than the previous priority number sent from the previous stage pixel data arbitration circuit, the previous pixel data sent from the previous stage pixel data arbitration circuit, and said pixel data calculating means for performing, when said first comparing means and said third comparing means respectively detect the coincidence and the second coincidence, a predetermined calculation between said previous pixel data sent from the previous stage pixel data arbitration circuit and said pixel data stored in the corresponding frame memory control means, and for outputting a calculated result resulting from the predetermined calculation, and said second group number generated from said outline generating means sent to the next stage pixel data arbitration circuit; and display means, operatively connected to said pixel data arbitration means, for displaying determined pixel data corresponding to the determined window.

4. A multiwindow display control apparatus as claimed in claim 3, wherein:

each of said frame memory control means stores a display enable signal indicating whether each pixel of the pixel data is to be displayed;

said selecting means selecting said priority number stored in the corresponding frame memory control means to be output to the next stage pixel data arbitration circuit when said display enable signal indicates that the each pixel is to be displayed; and said pixel data calculating means one of outputting said pixel data stored in the corresponding frame memory control means, and performing said predetermined calculation when said display enable signal indicates that the each pixel is to be displayed.

5. A multiwindow display control apparatus, for controlling a display of multiwindows having a plurality of groups of windows each of said plurality of groups of windows having a plurality of windows, comprising:

a plurality of frame memory control means for storing pixel data corresponding to each of said plurality of windows to be displayed, a first group number identifying said plurality of windows located in the each of said plurality of groups of windows, and a priority number identifying a display priority for the each of said plurality of windows located in the each of said plurality of groups of windows, said frame memory control means comprises corresponding frame memory control means, outline generating means for generating a second group number identifying a desired group of windows to be displayed;

pixel data arbitration means including a plurality of pixel data arbitration circuits connected to each other in a daisy chain structure, operatively connected to said corresponding frame memory control means and to said outline generating means, for determining a determined group of windows having a coincidence when said first group number coincides with said second group number, and for determining a determined window to be displayed having said priority number assigned the highest priority in the determined group of windows, said plurality of pixel data arbitration circuits includes a corresponding pixel data arbitration circuit, and means for forcibly changing the first group number, the priority number, and the pixel data;

said plurality of frame memory control means further includes forcible change instructing means for instructing the corresponding pixel data arbitration circuit using an enable signal to forcibly change the first group number, the priority number and the pixel data stored in a present stage frame memory control means of the plurality of frame memory control means, and when the forcible change instructing means outputs the enable signal for a forcible change, the second group number, a previous priority number and previous pixel data output from a previous stage pixel data arbitration circuit of the plurality of pixel data arbitration circuits are replaced with the first group number, the priority number, and the pixel data stored in the present stage frame memory control means, and are output to a next stage pixel data arbitration circuit of the plurality of pixel data arbitration circuits; and display means, operatively connected to said pixel data arbitration means, for displaying determined pixel data corresponding to the determined window.

6. A multiwindow display control apparatus, for controlling a display of multiwindows having a plurality of groups of windows each of said plurality of groups of windows having a plurality of windows, comprising:

a plurality of frame memory control means for storing pixel data corresponding to each of said plurality of windows to be displayed, a first group number identifying said plurality of windows located in the each of said plurality of groups of windows, and a priority number identifying a display priority for the each of said plurality of windows located in the each of said plurality of groups of windows, said frame memory control means includes corresponding frame memory control means and a forcible change signal generating means for generating a forcible change signal;

outline generating means for generating a second group number identifying a desired group of windows to be displayed;

pixel data arbitration means including a plurality of pixel data arbitration circuits connected to each other in a daisy chain structure, operatively connected to said corresponding frame memory control means and to said outline generating means, for determining a determined group of windows having a coincidence when said first group number coincides with said second group number, and for determining a determined window to be displayed having said priority number assigned the highest priority in the determined group of windows, and said plurality of pixel data arbitration circuits further including:

a previous pixel data arbitration circuit connected to said outline generating means for storing a previous priority number, and previous pixel data;

first comparing means for detecting the coincidence between said second group number generated from said outline generating means and said first group number stored in the corresponding frame memory control means;

second comparing means for detecting whether the priority number stored in the corresponding frame memory control means is larger than a previous priority number sent from the previous stage pixel data arbitration circuit;

first selecting means for outputting, when said forcible change signal is active, the first group number stored in the corresponding frame memory control means, and for outputting, when said forcible change signal is not active, said second group number generated from said outline generating means;

second selecting means for outputting, when one of said forcible change signal is active and said first comparing means detects the coincidence and said second comparing means detects that the priority number stored in the corresponding frame memory control means is larger than the previous priority number sent from the previous stage pixel data arbitration circuit, the priority number and the pixel data stored in the corresponding frame memory control means, and said second selecting means for outputting, when said forcible change signal is not active and when one of said first comparing means does not detect the coincidence, and said second comparing means detects that the priority number stored in the corresponding frame memory control means is smaller than the previous priority number sent from the previous stage pixel data arbitration circuit, the previous priority number and the previous pixel data sent from the previous stage pixel data arbitration circuit; and display means, operatively connected to said pixel data arbitration means, for displaying determined pixel data corresponding to the determined window.

7. A multiwindow display control apparatus as claimed in claim 6, wherein:

the plurality of pixel data arbitration circuits comprises a next stage pixel data arbitration circuit; and each of said frame memory control means stores a display enable signal indicating whether each pixel of the pixel data is to be displayed, and said first selecting means selects said first group number, said second selecting means selects said priority number, and the pixel data stored in the corresponding frame memory control means, said first group number, said priority number and said pixel data, to be output to the next stage pixel data arbitration circuit when said display enable signal indicates that the each pixel is to be displayed.

8. A multiwindow display control apparatus, for controlling a display of multiwindows having a plurality of groups of windows each of said plurality of groups of windows having a plurality of windows, comprising:

a plurality of frame memory control means for storing pixel data corresponding to each of said plurality of windows to be displayed, a first group number identifying said plurality of windows located in the each of said plurality of groups of windows, and a priority number identifying a display priority for the each of said plurality of windows located in the each of said plurality of groups of windows;

outline generating means for generating a second group number identifying a desired group of windows to be displayed, said outline generating means including:

display enable region address generating means for generating display addresses;

group window rectangular region generating means, operatively connected to said display enable region address generating means, for generating group window rectangular region signals for said each of said plurality of groups of windows;

special region generating means for generating special region signals;

display priority sorting means, operatively connected to said group window rectangular region generating means and said special region generating means, for sorting said group window rectangular region signals according to a desired order of display priorities for said each of said plurality of groups of windows;

display priority determining means, operatively connected to said display priority sorting means, for enabling a highest priority group window rectangular region signal of said group window rectangular region signals having a highest display priority; and group number register means, operatively connected to said display priority determining means, for outputting a highest priority group number signal assigned to a highest priority group window having the highest display priority;

pixel data arbitration means, operatively connected to said plurality of frame memory control means and to said outline generating means for determining a determined group of windows having a coincidence when said first group number coincides with said second group number, and for determining a determined window to be displayed having said priority number assigned the highest priority in the determined group of windows; and display means, operatively connected to said pixel data arbitration means, for displaying determined pixel data corresponding to the determined window.

9. A multiwindow display control apparatus as claimed in claim 8, wherein:

said plurality of groups of windows comprise a corresponding group window; and each of said group window rectangular region generating means comprises X start address detecting means for detecting an X start address of the corresponding group window;

Y start address detecting means for detecting a Y start address of the corresponding group window;

X end address detecting means for detecting an X end address of the corresponding group window; and Y end address detecting means for detecting a Y address of the corresponding group window.

10. A multiwindow display control apparatus as claimed in claim 8, wherein said special region generating means comprises:

a change point coordinate storing memory for storing change point coordinates between said plurality of groups of windows to be displayed on a display enable region.

11. A multiwindow display control apparatus as claimed in claim 8, wherein said pixel data arbitration means comprises a plurality of pixel data arbitration circuits and said frame memory control means comprises corresponding frame memory control means, said arbitration circuits connected to said corresponding frame memory control means, said plurality of pixel data arbitration circuits connected to each other in a daisy chain structure.

12. A multiwindow display control apparatus as claimed in claim 11, wherein:

the plurality of groups of windows comprises a corresponding group of windows; and each of said plurality of pixel data arbitration circuits comprises a previous stage pixel data arbitration circuit connected to said outline generating means storing previous pixel data and a previous priority number;

a next stage pixel data arbitration circuit connected to said outline generating means;

first comparing means for detecting the coincidence between said second group number generated from said outline generating means and said first group number stored in the corresponding frame memory control means;

second comparing means for detecting whether the priority number stored in the corresponding frame memory control means is larger than the previous priority number sent from the previous stage pixel data arbitration circuit;

first selecting means for selecting a selected group window rectangular region signal of the corresponding group of windows in response to said highest priority group number signal output from the corresponding frame memory control means, said selected group window rectangular region signal being supplied to the corresponding frame memory control means for determining a display position of the pixel data using relative coordinates with respect to said group window rectangular region signal; and second selecting means for outputting, when said first comparing means detects the coincidence and said second comparing means detects that the priority number stored in the corresponding frame memory control means is larger than the previous priority number sent from the previous stage pixel data arbitration circuit, the priority number and the pixel data stored in the corresponding frame memory control means, and said second selecting means for outputting, when one of said first comparing means does not detect the coincidence and said second comparing means detects that the priority number stored in the corresponding frame memory control means is smaller than the previous priority number sent from the previous stage pixel data arbitration circuit, the previous priority number and the previous pixel data sent from the previous stage pixel data arbitration circuit, and second group number generated from said outline generating means being sent to the next stage pixel data arbitration circuit.

13. A multiwindow display control apparatus as claimed in claim 12, wherein each of said plurality of frame memory control means stores a display enable signal indicating whether each pixel of the pixel data is to be displayed, and said second selecting means selects said priority number and the pixel data stored in the corresponding frame memory control means to be output to the next stage pixel data arbitration circuit when said display enable signal indicates that the each pixel is to be displayed.

14. A multiwindow display control apparatus as claimed in claim 8, wherein each of said plurality of pixel data arbitration circuits comprises:

a previous stage pixel data arbitration circuit connected to said outline generating means storing previous pixel data, and a previous priority number;

a next stage pixel data arbitration circuit connected to said outline generating means;

first selecting means for selecting a selected group window rectangular region signal of a corresponding group window from said plurality of groups of windows in response to said highest priority group number signal output from the corresponding frame memory control means, said selected group window rectangular region signal being supplied to the corresponding frame memory control means for determining a display position of the pixel data using relative coordinates with respect to said group window rectangular region signal; and first comparing means for detecting the coincidence between said second group number generated from said outline generating means and said first group number stored in the corresponding frame memory control means;

second comparing means for detecting whether the priority number stored in the corresponding frame memory control means is larger than the previous priority number sent from the previous stage pixel data arbitration circuit;

second selecting means for outputting, when said first comparing means detects the coincidence and said second comparing means detects that the priority number stored in the corresponding frame memory control means is larger than the previous priority number sent from the previous stage pixel data arbitration circuit, the priority number in the corresponding frame memory control means, and said second selecting means for outputting, when one of said first comparing means does not detect the coincidence and said second comparing means detects that the priority number stored in the corresponding frame memory control means is smaller than the previous priority display position of the pixel data using relative coordinates with respect to said group window rectangular region signal;

first comparing means for detecting the coincidence between said second group number generated from said outline generating means and said first group number stored in the corresponding frame memory control means;

second comparing means for detecting whether the priority number stored in the corresponding frame memory control means is larger than the previous priority number sent from the previous stage pixel data arbitration circuit;

second selecting means for outputting, when said forcible change signal is active, the first group number stored in the corresponding frame memory control means, and for outputting, when said forcible change signal is not active, said second group number generated from said outline generating means; and third selecting means for outputting, when one of said forcible change signal is active and said first comparing means detects the coincidence and said second comparing means detects that the priority number stored in the corresponding frame memory control means is larger than the previous priority number sent from the previous stage pixel data arbitration circuit, the priority number and the pixel data stored in the corresponding frame memory control means, and said third selecting means for outputting, when said forcible change signal is not active and when one of said first comparing means does not detect the coincidence and said second comparing means detects that the priority number stored in the corresponding frame memory control means is smaller than the previous priority number sent from the previous stage pixel data arbitration circuit, the previous priority number and the number sent from the previous stage pixel data arbitration circuit, the previous priority number sent from the previous stage pixel data arbitration circuit;

third comparing means for detecting a second coincidence between the previous priority number sent from the previous stage pixel data arbitration circuit and the priority number stored in the corresponding frame memory control means; and pixel data calculating means for outputting, when said first comparing means detects the coincidence and said second comparing means detects the priority number stored in the corresponding frame memory control means is larger than the previous priority number sent from the previous stage pixel data arbitration circuit, the pixel data stored in the corresponding frame memory control means, said pixel data calculating means for outputting, when one of said first comparing means does not detect the coincidence and said second comparing means detects that the priority number stored in the corresponding frame memory control means is smaller than the previous priority number sent from the previous stage pixel data arbitration circuit, the previous pixel data sent from the previous stage pixel data arbitration circuit, and said pixel data calculating means for performing, when said first comparing means and said third comparing means respectively detect the coincidence and the second coincidence, a predetermined calculation between said previous pixel data sent from the previous stage pixel data arbitration circuit and said pixel data stored in the corresponding frame memory control means, and for outputting a calculated result resulting from the predetermined calculation, and said second group number generated from said outline generating means sent to the next stage pixel data arbitration circuit.

15. A multiwindow display control apparatus as claimed in claim 14, wherein:

each of said plurality of frame memory control means stores a display enable signal indicating whether each pixel of the pixel data is to be displayed;

said second selecting means selecting said priority number stored in the corresponding frame memory control means to be output to the next stage pixel data arbitration circuit when said display enable signal indicates that the each pixel is to be displayed; and said pixel data calculating means one of outputting said pixel data stored in the corresponding frame memory control means, and performing said predetermined calculation when said display enable signal indicates that the each pixel is to be displayed.

16. A multiwindow display control apparatus as claimed in claim 8, wherein said plurality of frame memory control means comprises forcible change signal generating means for generating a forcible change signal, and said pixel data arbitration circuits comprises:

a previous stage pixel data arbitration circuit connected to said outline generating means storing previous pixel data a previous priority number;

first selecting means for selecting a selected group window rectangular region signal of a corresponding group of windows from said plurality of groups of windows in response to said highest priority group number signal output from the corresponding frame memory control means, said selected group window rectangular regions signal being supplied to the corresponding frame memory control means for determining a previous pixel data sent from the previous stage pixel data arbitration circuit.

17. A multiwindow display control apparatus as claimed in claim 16, wherein:

said plurality of pixel data arbitration circuits comprises a next stage pixel data arbitration circuit; and each of said frame memory control means stores a display enable signal indicating whether each pixel of the pixel data is to be displayed, and said first selecting means and said third selecting means select said group number, said priority number, and the pixel data stored in the corresponding frame memory control means to be output to the next stage pixel data arbitration circuit when said display enable signal indicates that the each pixel is to be displayed.

* * * * *

UNITED STATES PATENT AND TRADEMARK OFFICE

CERTIFICATE OF CORRECTION

PATENT NO. : 5,600,346

DATED : February 4, 1997

INVENTOR(S) : Hajime KAMATA, et al.

It is certified that error appears in the above-indentified patent and that said Letters Patent is hereby corrected as shown below:

Column 8, lines 33-34, delete paragraph.
Column 14, line 17, change "dotsxn" to -- dot s x n --.
Column 15, line 31, change "15-(n-1)" to -- 15 - (n-1) --.
Column 17, line 38, change "15-(n-1)" to -- 15 - (n-1) --.
Column 30, line 19, beginning with "first" delete everything through line 50, "priority".
Column 30, line 52, delete "and the number".
Column 30, line 53, delte ", the".
Column 30, lines 54-55, delete in their entirety.

UNITED STATES PATENT AND TRADEMARK OFFICE

CERTIFICATE OF CORRECTION

PATENT NO. : 5,600,346

DATED : February 4, 1997

INVENTOR(S) : Hajime KAMATA, et al.

It is certified that error appears in the above-indentified patent and that said Letters Patent is hereby corrected as shown below:

Column 32, line 19, after "circuit", insert --; first comparing means for detecting the coincidence between said second group number generated from said outline generating means and said first group number stored in the corresponding frame memory control means;

second comparing means for detecting whether the priority number stored in the corresponding frame memory control means is larger than the previous priority number sent from the previous stage pixel data arbitration circuit;

second selecting means for outputting, when said forcible change signal is active, the first group number stored in the corresponding frame memory control means, and for outputting, when said forcible change signal is not active, said second group number generated from said outline generating means; and third selecting means for outputting, when one of said forcible change signal is active and said first comparing means detects the coincidence and said second comparing means detects that the priority number stored in the corresponding frame memory control means, and said third selecting means for outputting, when said forcible change signal is not active and when one of said first comparing means does not detect the coincidence and said second comparing means detects that the priority number stored in the corresponding frame memory control means is smaller than the previous priority number sent from the previous stage pixel data arbitration circuit, the previous priority number and the previous pixel data sent from the previous stage pixel data arbitration circuit --.

Signed and Sealed this

First Day of July, 1997

Bruce Lehman

*Attest:*

BRUCE LEHMAN

*Attesting Officer*

*Commissioner of Patents and Trademarks*